US012258863B2

(12) United States Patent
Ashikaga

(10) Patent No.: US 12,258,863 B2
(45) Date of Patent: Mar. 25, 2025

(54) CONTROL METHOD FOR TUNNEL EXCAVATION DEVICE AND TUNNEL EXCAVATION DEVICE

(71) Applicant: KOMATSU LTD., Tokyo (JP)

(72) Inventor: Shigeaki Ashikaga, Tokyo (JP)

(73) Assignee: KOMATSU LTD., Tokyo (JP)

( * ) Notice: Subject to any disclaimer, the term of this patent is extended or adjusted under 35 U.S.C. 154(b) by 213 days.

(21) Appl. No.: 17/919,409

(22) PCT Filed: Apr. 22, 2021

(86) PCT No.: PCT/JP2021/016370
§ 371 (c)(1),
(2) Date: Oct. 17, 2022

(87) PCT Pub. No.: WO2021/241092
PCT Pub. Date: Dec. 2, 2021

(65) Prior Publication Data

US 2023/0175396 A1 Jun. 8, 2023

(30) Foreign Application Priority Data

May 29, 2020 (JP) ..... 2020-094432

(51) Int. Cl.
*E21D 9/10* (2006.01)
*E21D 9/11* (2006.01)

(52) U.S. Cl.
CPC ..... *E21D 9/1093* (2013.01); *E21D 9/11* (2013.01)

(58) Field of Classification Search
CPC ..... E21D 9/1093; E21D 9/11; E21D 9/108
See application file for complete search history.

(56) References Cited

U.S. PATENT DOCUMENTS 4,420,188 A 12/1983 Robbins et al.
4,637,657 A * 1/1987 Snyder ..... E21D 9/112 299/33

(Continued)

FOREIGN PATENT DOCUMENTS

CN 102777176 A 11/2012
CN 104334832 A 2/2015

(Continued)

OTHER PUBLICATIONS

The International Search Report for the corresponding international application No. PCT/JP2021/016370, issued on Jul. 20, 2021.

(Continued)

*Primary Examiner* — Carib A Oquendo
(74) *Attorney, Agent, or Firm* — Global IP Counselors, LLP

(57) ABSTRACT

A control method for a tunnel excavation device is provided. While grippers of a rear body section protrude outward and the rear body section is secured to an inner wall of a tunnel, a plurality of thrust cylinders are controlled so that a front body section is made to move forward along a movement prediction line set based on a tunnel excavation plan line. While grippers of the front body section protrude outward and the front body section is secured to the inner wall of the tunnel, the plurality of thrust cylinders are controlled so that the rear body section is made to move forward along a movement prediction line set based on an actual result line.

19 Claims, 16 Drawing Sheets

(56) References Cited

U.S. PATENT DOCUMENTS

| | | | | |
|---|---|---|---|---|
| 5,296,915 | A * | 3/1994 | Akesaka | E21D 9/004 299/1.8 |
| 6,226,573 | B1 * | 5/2001 | Okawa | G05D 1/0282 701/25 |
| 8,453,759 | B2 * | 6/2013 | Saleniemi | E21B 7/022 173/4 |
| 2010/0148566 | A1 * | 6/2010 | Home | E21D 20/003 299/31 |
| 2016/0230552 | A1 | 8/2016 | Kuramoto | |
| 2016/0230553 | A1 | 8/2016 | Kuramoto | |
| 2023/0175396 | A1 * | 6/2023 | Ashikaga | E21D 9/11 299/10 |

FOREIGN PATENT DOCUMENTS

| | | | |
|---|---|---|---|
| CN | 104395555 | A | 3/2015 |
| CN | 104863603 | A | 8/2015 |
| CN | 105518253 | A | 4/2016 |
| CN | 107989625 | A | 5/2018 |
| CN | 108019217 | A | 5/2018 |
| CN | 207750086 | U | 8/2018 |
| JP | 9-88481 | A | 3/1997 |
| JP | 9-158681 | A | 6/1997 |
| JP | 2005-120652 | A | 5/2005 |
| JP | 2007-205072 | A | 8/2007 |
| JP | 2015-105512 | A | 6/2015 |
| KR | 10-1550159 | B1 | 9/2015 |

OTHER PUBLICATIONS

The Office Action for the corresponding Chinese application No. 202180021456.4 issued on Apr. 25, 2024.

Wu, Demin, "Breakdown Analysis of Shield Tunnelling Machines" published in Construction Technology, Dec. 2015, vol. 44, China Academic Journal Electronic Publishing House.

Zhao, Yaqi et al., "PSO-PID Control for Thrust Hydraulic System of Tunnel Boring Machine" published in Control Engineering of China, Aug. 2016, vol. 23, No. 87, China Academic Journal Electronic Publishing House.

* cited by examiner

CONTROL METHOD FOR TUNNEL EXCAVATION DEVICE AND TUNNEL EXCAVATION DEVICE

CROSS-REFERENCE TO RELATED APPLICATIONS

This application is a U.S. National stage application of International Application No. PCT/JP2021/016370, filed on Apr. 22, 2021. This U.S. National stage application claims priority under 35 U.S.C. § 119(a) to Japanese Patent Application No. 2020-094432, filed in Japan on May 29, 2020, the entire contents of which are hereby incorporated herein by reference.

TECHNICAL FIELD

The present disclosure relates to a control method and a tunnel excavation device for a tunnel excavation device used when excavating a tunnel.

BACKGROUND INFORMATION

Tunnel excavation is performed by using an excavator provided with a cutter head that includes cutters on a machine front surface and grippers provided on the left and right side surfaces at the rear of the machine. This excavator excavates the tunnel by pressing the cutter head against the working face while rotating the cutter head while the left and right grippers are pressed against the left and right side walls (for example, see Japanese Patent Laid-open No. 2015-105512).

Japanese Patent Laid-open No. 2015-105512 discloses a method for controlling a tunnel excavation device comprising a front body section that includes cutters for performing tunnel excavation, and a rear body section that includes grippers for achieving a counterforce for excavation and that is coupled to the front body section via a plurality of thrust cylinders.

In this tunnel excavation device, an operator checks a display monitor and adjusts the strokes of the thrust cylinders so as not to deviate from a planned excavation line when the advancing direction of the tunnel excavation device has changed from the planned excavation line due to changes in the hardness of the bedrock material, etc., while excavating a curved tunnel.

SUMMARY

However, because the position of only the front body section is adjusted in Japanese Patent Laid-open No. 2015-105512, it is difficult to cause the rear body section to move along the inner wall when there is a sharp curve in the tunnel.

An object of the present disclosure is to provide a control method for a tunnel excavation device and a tunnel excavation device that is capable of moving along a tunnel inner wall even when there is a sharp curve.

A control method for a tunnel excavation device according to a first disclosure is a method for controlling a tunnel excavation device comprising a front body section including a plurality of cutters, a rear body section disposed to the rear of the front body section, and a plurality of thrust cylinders disposed between the front body section and the rear body section, the method comprising a first forward travel step and a second forward travel step. In the first forward travel step, the plurality of thrust cylinders are controlled so that the front body section moves forward along a movement prediction line set on the basis of a first path line while grippers of the rear body section protrude outward and the rear body section is secured to the inner wall of the tunnel. In the second forward travel step, the plurality of thrust cylinders are controlled so that the rear body section moves forward along a movement prediction line set on the basis of a second path line while grippers of the front body section protrude outward and the front body section is secured to the inner wall of the tunnel.

A tunnel excavation device control method according to a second disclosure is a method for controlling a tunnel excavation device comprising a front body section including a plurality of cutters, a rear body section disposed to the rear of the front body section, and a plurality of thrust cylinders disposed between the front body section and the rear body section, the method comprising a first reverse travel step. In the first reverse travel step, the plurality of thrust cylinders are controlled so that the rear body section moves in reverse along a movement prediction line set on the basis of a third path line while grippers of the front body section protrude outward and the front body section is secured to the inner wall of the tunnel.

A tunnel excavation device according to a third disclosure comprises a front body section, a rear body section, a plurality of thrust cylinders, and a controller. The front body section includes a plurality of cutters and grippers that press against an inner wall of the tunnel. The rear body section includes grippers that press against the inner wall of the tunnel, and is disposed to the rear of the front body section. The plurality of thrust cylinders are disposed between the front body section and the rear body section. The controller controls the plurality of thrust cylinders so that the front body section moves forward along a movement prediction line set on the basis of a first path line while the grippers of the rear body section protrude outward and the rear body section is secured to the inner wall of the tunnel, and controls the plurality of thrust cylinders so that the rear body section moves forward along a movement prediction line set on the basis of a second path line while the grippers of the front body section protrude outward and the front body section is secured to the inner wall of the tunnel.

A tunnel excavation device according to a fourth disclosure comprises a front body section, a rear body section, a plurality of thrust cylinders, and a controller. The front body section includes a plurality of cutters and grippers that press against an inside wall of the tunnel. The rear body section includes grippers that press against the inner wall of the tunnel, and is disposed to the rear of the front body section. The plurality of thrust cylinders are disposed between the front body section and the rear body section. The controller controls the plurality of thrust cylinders so that the rear body section moves in reverse along a movement prediction line set on the basis of a third path line while the grippers of the front body section protrude outward and the front body section is secured to the inner wall of the tunnel.

According to the present disclosure, there is provided a control method for a tunnel excavation device and a tunnel excavation device that is capable of moving along a tunnel inner wall even when there is a sharp curve.

DESCRIPTION OF EMBODIMENTS

A tunnel excavation device and a control method for a tunnel excavation device in an embodiment according to the present disclosure will be explained with reference to the drawings.

The tunnel excavation device 10 (FIG. 1, etc.) of the present embodiment is an excavation device used in tunnel excavation and is a so-called gripper tunnel boring machine (TBM) or a hard rock TBM among TBMs. In addition, the tunnel (tunnel T1) excavated by the tunnel excavation device 10 in the present embodiment is a tunnel (tunnel T1 (see FIG. 2)) having a roughly circular cross-section. The cross-sectional shape of the tunnel excavated by the tunnel excavation device 10 according to the present embodiment is not limited to a circular shape and may have an oval shape, a double circular shape, or a horseshoe shape.

(Outline of the Tunnel Excavation Device 10)

Figure 1:
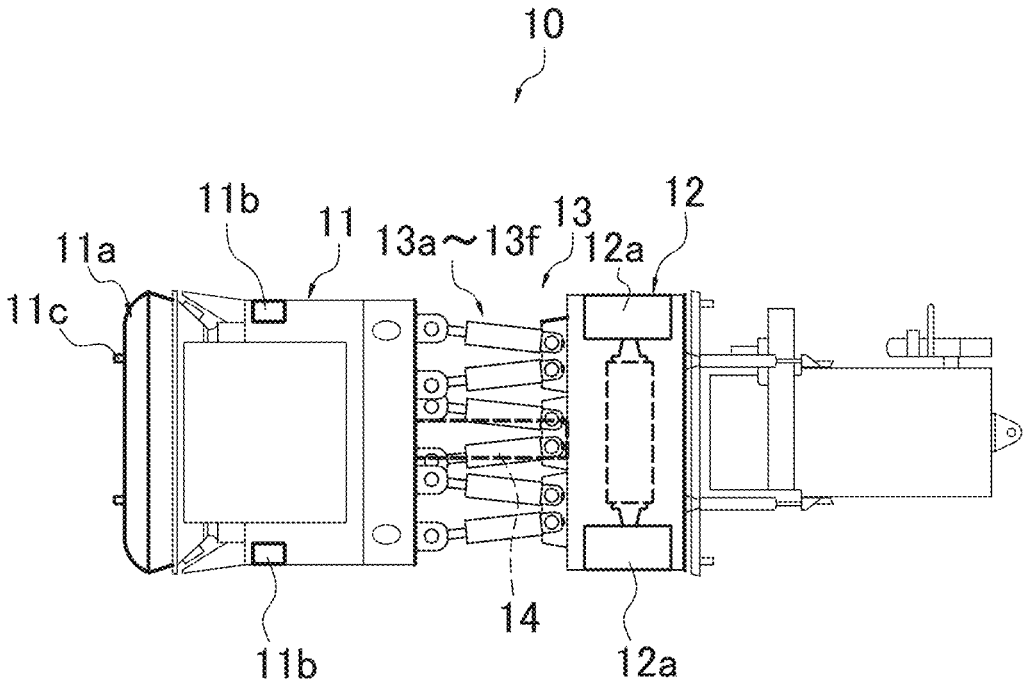
FIG. 1 is an overall view illustrating a configuration of a tunnel excavation device of an embodiment according to the present disclosure.

FIG. 1 is an overall view illustrating a configuration of the tunnel excavation device 10.

Figure 2:
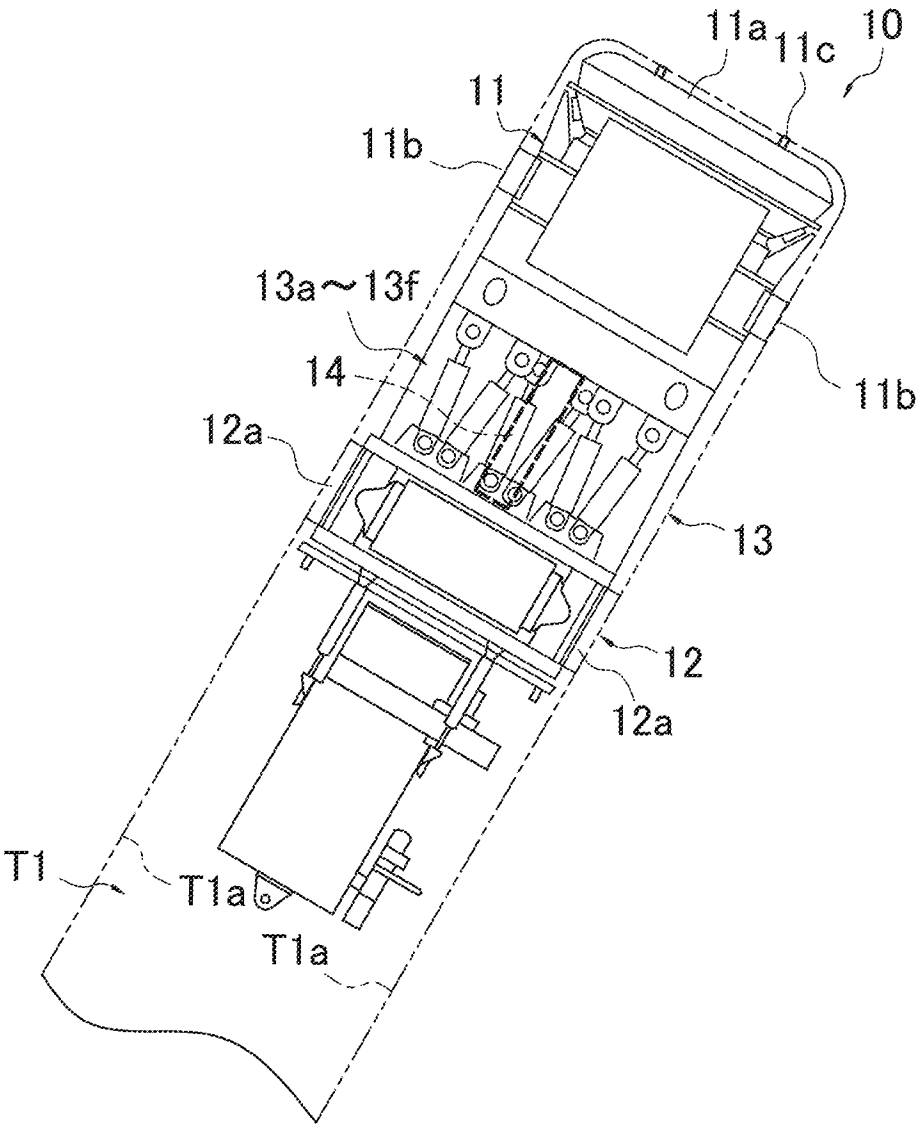
FIG. 2 is a cross-sectional view illustrating a state of using the tunnel excavation device in FIG. 1 for tunnel excavation in a straight line.

The tunnel excavation device 10 excavates, for example, a first tunnel T1 (see FIG. 2). The tunnel excavation device 10 discussed in the present embodiment causes a cutter head 11*a* to rotate to perform excavating while being supported from behind with grippers 12*a*.

The tunnel excavation device 10 is a device that performs excavation work of the first tunnel T1 by advancing while excavating bedrock or the like, and comprises a front body section 11, a rear body section 12, a linking mechanism 13, a conveyor belt 14, a controller 15 (see FIG. 4), and a display input component 16 (see FIG. 4) as illustrated in FIG. 1.

The front body section 11 includes the cutter head 11*a* and excavates the bedrock or the like. The rear body section 12 is disposed to the rear of the front body section 11. The linking mechanism 13 connects the rear body section 12 to the front body section 11. The front body section 11 is able to bend with respect to the rear body section 12 due to the linking mechanism 13. The conveyor belt 14 transports earth and sand excavated by the cutter head 11*a* to the rear.

The controller 15 controls the operations of the front body section 11, the rear body section 12, the linking mechanism 13, and the conveyor belt 14. The display input component 16 is, for example, a touch panel type monitor screen and receives operation inputs from an operator. The linking mechanism 13 is operated by inputs from the operator and the bending of the front body section 11 with respect to the rear body section 12 is changed. While not illustrated, a plurality of vehicles provided with a control device, a power supply device, and a hydraulic system, etc., for driving the cutter head 11*a*, the grippers 12*a*, the conveyor belt 14, and a plurality of thrust cylinders 13*a* to 13*f* of the linking mechanism 13, are joined to the rear of the rear body section 12, and an operator's seat is provided in any of the vehicles. The display input component 16 is disposed, for example, in front of the operator's seat.

(Front Body Section 11)

The front body section 11 is disposed in the front section of the tunnel excavation device 10. The position and attitude of the front body section 11 with respect to the rear body section 12 are changed by the plurality of below-mentioned thrust cylinders 13*a* to 13*f* included in the linking mechanism 13. The front body section 11 includes the cutter head 11*a* and grippers 11*b*.

The cutter head 11*a* is disposed at the tip of the front body section 11. The cutter head 11*a* has a roughly circular shape as seen from the front, and rotates around a center shaft as a center of rotation thereby excavating the bedrock, etc., with a plurality of disk cutters 11*c* provided to the front surface on the tip end side. The cutter head 11*a* takes in the bedrock and stones finely ground by the disk cutters 11*c* through openings (not illustrated) formed on the front surface.

The grippers 11*b* are provided at least to both sides of the front body section 11 in the width direction. The grippers 11*b* protrude from the outer circumferential surface of the front body section 11 toward a side wall T1*a* of the tunnel T1 and are pressed against the side wall The as illustrated in FIG. 2. As a result, for example, when causing the tunnel excavation device 10 to travel in reverse, the linking mechanism 13 is driven in the extending direction while the front body section 11 is supported on the tunnel T1, whereby the rear body section 12 is able to travel in reverse.

(Rear Body Section 12)

The rear body section 12 is disposed in the rear section of the tunnel excavation device 10 as illustrated in FIG. 1. The rear body section 12 is disposed to the rear of the front body section 11.

The grippers 12*a* are installed on both sides of the rear body section 12 in the width direction. The rear body section 12 and the front body section 11 are coupled by the linking mechanism 13.

The grippers 12*a* protrude from the outer circumferential surface of the rear body section 12 radially toward the outside as illustrated in FIG. 2, and are pressed against the side wall Tia of the first tunnel T1 during excavation. As a result, the rear body section 12 is able to provide support in the first tunnel T1.

(Linking Mechanism 13)

The linking mechanism 13 is disposed in the middle in the front-back direction of the tunnel excavation device 10 as illustrated in FIG. 1, and the linking mechanism 13 includes six sets of the thrust cylinders 13*a* to 13*f* which are hydraulic actuators. As a result, by extending and retracting each of the thrust cylinders 13*a* to 13*f* between the front body section 11 and the rear body section 12, the first tunnel T1 is excavated by the cutter head 11*a* while the attitude (orientation) of the front body section 11 with respect to the rear body section 12 is controlled so as to face in the desired direction.

The six sets of thrust cylinders 13*a* to 13*f* are disposed side by side between the front body section 11 and the rear body section 12 as links and couple the front body section 11 and the rear body section 12. The six sets of thrust cylinders 13*a* to 13*f* are disposed in a lattice structure. The ends on the rod side of the six sets of thrust cylinders 13*a* to 13*f* are connected to portions of the front body section 11 facing the rear body section 12. The ends on the cylinder side of the thrust cylinders 13*a* to 13*f* are connected to portions of the rear body section 12 facing the front body section 11.

By extending the thrust cylinders 13*a* to 13*f*, the front body section 11 is made to travel forward with respect to the rear body section 12 or the rear body section 12 is made to travel in reverse with respect to the front body section 11, whereby the tunnel excavation device 10 is enabled to travel forward or travel in reverse step by step. In addition, by retracting the thrust cylinders 13*a* to 13*f*, the rear body section 12 is pulled toward the front body section 11 or the front body section 11 is pulled toward the rear body section 12, whereby the tunnel excavation device 10 is enabled to travel forward or travel in reverse step by step.

Figure 4:
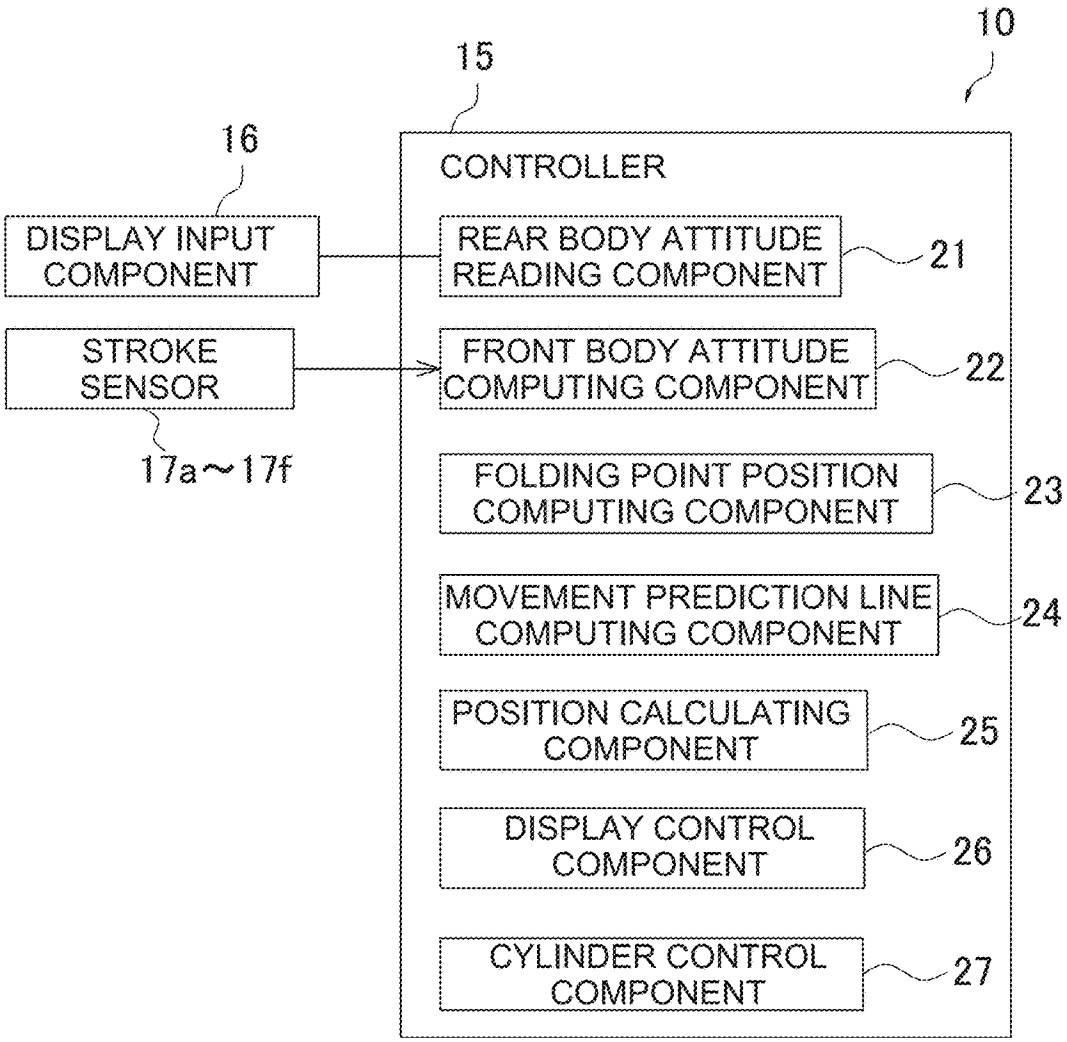
FIG. 4 is a block diagram illustrating a control configuration of the tunnel excavation device in FIG. 1.

Each of the thrust cylinders 13*a* to 13*f* respectively have attached thereto below-mentioned stroke sensors 17*a* to 17*f* as illustrated in FIG. 4. The stroke sensors 17*a* to 17*f* acquire the stroke amounts of each of the thrust cylinders 13*a* to 13*f*.

(Conveyor Belt 14)

The conveyor belt 14 is provided between the front body section 11 and the rear body section 12 and transports the bedrock or stones excavated by the cutter head 11*a* from the front body section 11 toward the rear body section 12.

A virtual folding point Px (see FIG. 5) that serves as a bending point in the front-back direction of the tunnel excavation device 10, is located near the conveyor belt 14. By adjusting the stroke amounts of the thrust cylinders 13*a* to 13*f*, the front body section 11 can be slanted with respect to the rear body section 12 by using the virtual folding point Px as a bending point, whereby excavation is also made possible in directions other than straight ahead.

The tunnel excavation device 10 is held so as not to move inside the first tunnel T1 due to the grippers 12*a* being pressed against the side wall Tia of the first tunnel T1 according to the above configuration. In this state, the thrust cylinders 13*a* to 13*f* of the linking mechanism 13 are extended and the cutter head 11*a* is pressed forward while the cutter head 11*a* at the tip end side is rotated to excavate the bedrock, etc., and travel forward.

At this time, the excavated bedrock and stones are transported to the rear by the conveyor belt 14, etc., in the tunnel excavation device 10. By doing so, the tunnel excavation device 10 is able to dig through the first tunnel T1 (see FIG. 2).

Figure 3:
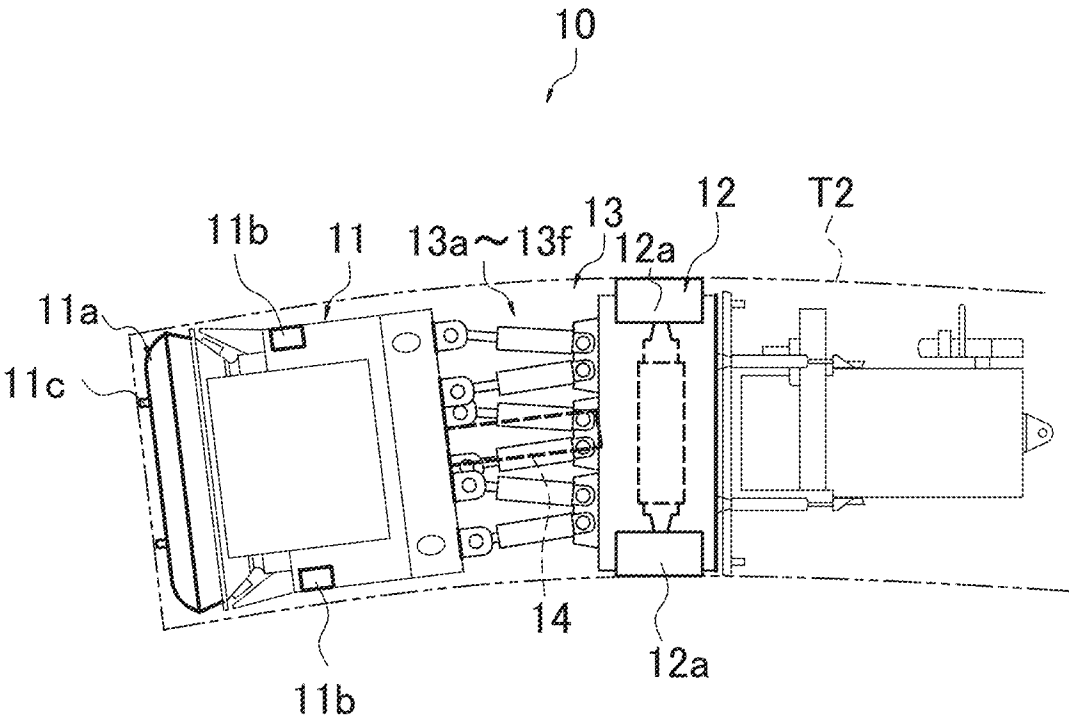
FIG. 3 is a cross-sectional view illustrating a state of using the tunnel excavation device in FIG. 1 for tunnel excavation in a curved line.

In addition, by digging while the front body section 11 is slanted with respect to the rear body section 12, a curved tunnel T2 can be dug as illustrated in FIG. 3.

(Types of Operations of the Tunnel Excavation Device 10)

According to the above configurations, the tunnel excavation device 10 tunnels (travels forward) or travels in reverse by performing the following operations.

(Tunneling)

During tunneling, the thrust cylinders 13*a* to 13*f* are extended while the grippers 12*a* of the rear body section 12 protrude outward and the rear body section 12 is secured to the tunnel inner wall, whereby the front body section 11 travels forward with respect to the rear body section 12. The cutter head 11*a* is rotated at this time and excavation is carried out.

During tunneling, the thrust cylinders 13*a* to 13*f* are retracted while the grippers 11*b* of the front body section 11 protrude outward and the front body section 11 is secured to the tunnel inner wall, whereby the rear body section 12 travels forward and approaches the front body section 11 (also referred to as a replacing operation).

By repeating the above operations, the tunnel excavation device 10 is able to travel forward.

(Reverse Travel)

During reverse travel, the thrust cylinders 13*a* to 13*f* are extended while the grippers 11*b* of the front body section 11 protrude outward and the front body section 11 is secured to the tunnel inner wall, whereby the rear body section 12 travels in reverse.

During reverse travel, the thrust cylinders 13*a* to 13*f* are retracted while the grippers 12*a* of the rear body section 12 protrude outward and the rear body section 12 is secured to the tunnel inner wall, whereby the front body section 11 travels in reverse and approaches the rear body section 12.

By repeating the above operations, the tunnel excavation device 10 is able to travel in reverse.

(Controller 15)

The controller 15 includes a processor and a storage device. The processor is, for example, a central processing unit (CPU). Alternatively, the processor may be a processor different from a CPU. The processor executes processing for controlling the tunnel excavation device 10 in accordance with a program. The storage device includes a non-volatile memory, such as a read-only memory (ROM), and a volatile memory, such as a random access memory (RAM). The storage device may include an auxiliary storage device, such as a hard disk or a solid state drive (SSD). The storage device is an example of a non-transitory computer-readable recording medium. The storage device stores programs and data for controlling the tunnel excavation device 10.

Instruction signals are input to the controller 15 from the display input component 16 by an operator. The operator is able to operate the display input component 16 and select tunneling or travel in reverse. The information of the operation selected by the operator is input to the controller 15.

The detection values of the stroke sensors 17*a* to 17*f* are input to the controller 15 and the controller 15 is able to acquire the stroke amounts of the thrust cylinders 13*a* to 13*f*.

Figure 5:
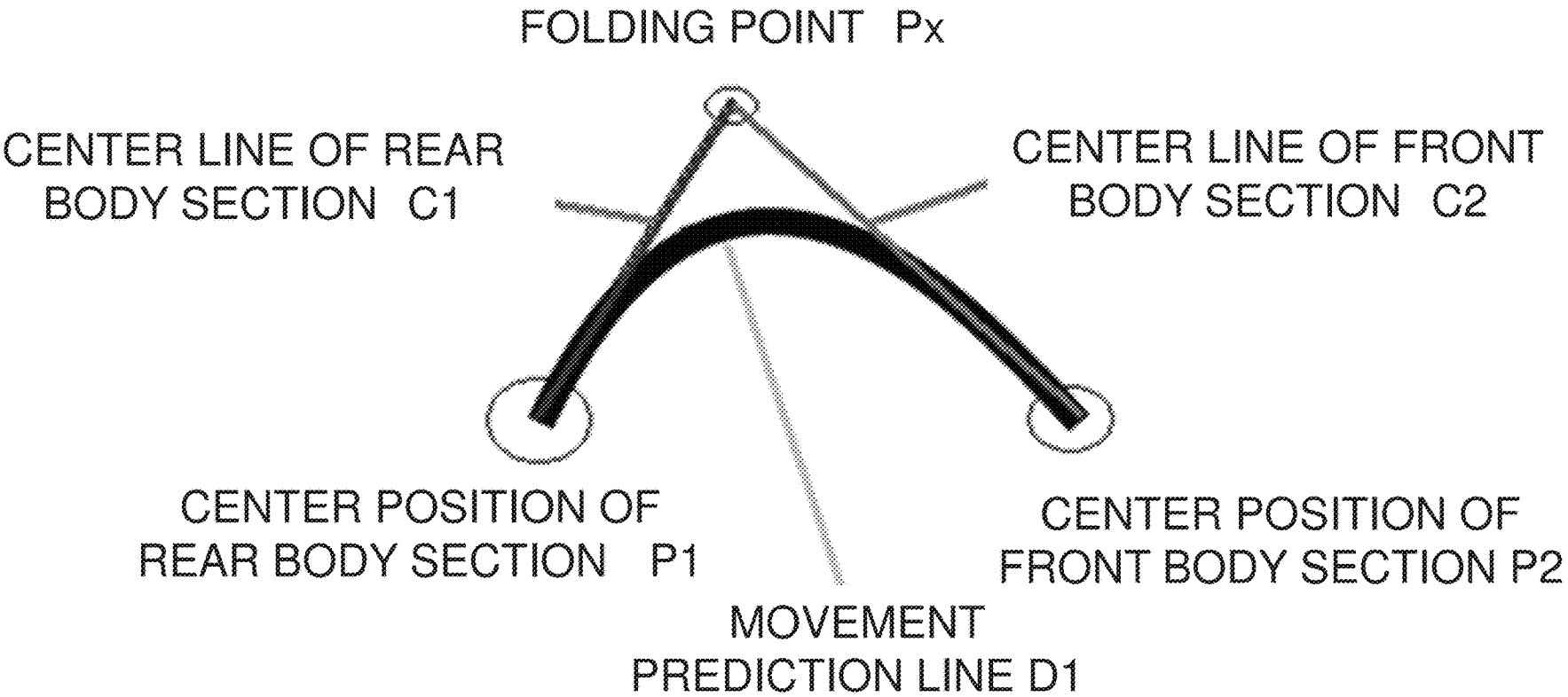
FIG. 5 is an explanation diagram illustrating a curve used when controlling the tunnel excavation device in FIG. 1.
Figure 6:
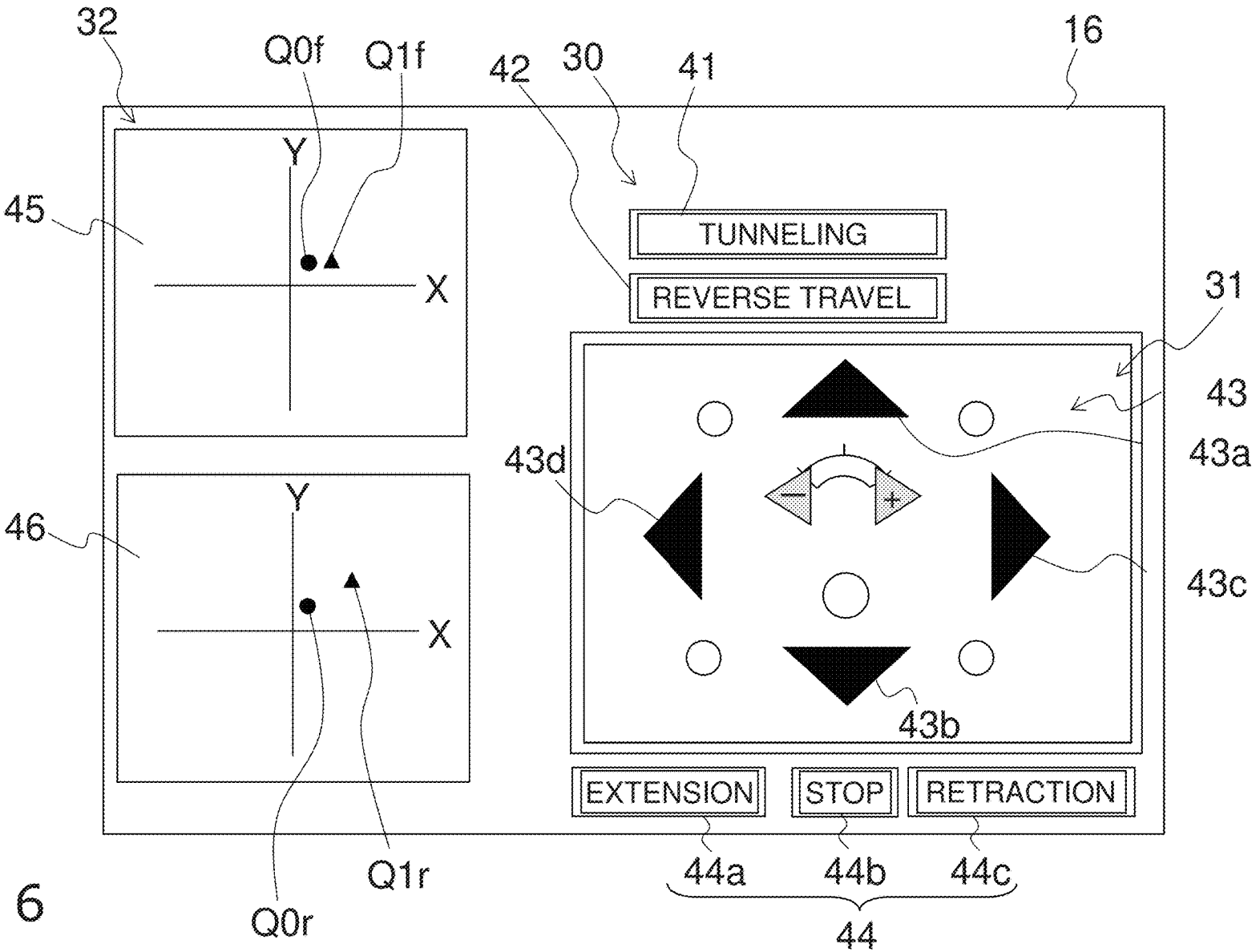
FIG. 6 illustrates a display input component of the tunnel excavation device in FIG. 1.

The controller 15 includes a rear body attitude reading component 21, a front body attitude computing component 22, a folding point position computing component 23, a movement prediction line computing component 24, a position calculating component 25, a display control component 26, and a cylinder control component 27. FIG. 5 illustrates a movement prediction line derived by the controller 15.

The rear body attitude reading component 21 derives a center position P1 and a center line C1 (orientation) from the current position and the attitude of the rear body section 12 (see FIG. 5). The center position P1 and the center line C1 of the rear body section 12 can be derived by surveying by using, for example, a total station (not illustrated). The center position P1 is, for example, the center in the width direction of the rear body section 12 and can be set to be the center in the total length in the front-back direction of the rear body section 12. The center line C1 can also be set, for example, to be a center line in the width direction of the rear body section 12. The height positions of the center position P1 and the center line C1 may be set to be any position and may be set, for example, as the middle of the entire height of the rear body section 12.

The front body attitude computing component 22 computes a center position P2 and attitude (center line C2) of the front body section 11 with respect to the rear body section 12 on the basis of the position information of the center position P1 and the center line C1 of the rear body section 12 derived by the rear body attitude reading component 21 and the stroke amounts of the thrust cylinders 13*a* to 13*f*. More specifically, the front body attitude computing component 22 is connected to the stroke sensors 17*a* to 17*f* respectively attached to the thrust cylinders 13*a* to 13*f* as illustrated in FIG. 4 and acquires the stroke amounts of the thrust cylinders 13*a* to 13*f*. As a result, the front body attitude computing component 22 is able to acquire information related to the stroke amounts of the thrust cylinders 13*a* to 13*f* that is required for computing the position and attitude of the front body section 11. The center position P2 can be set to be, for example, the center in the width direction of the front body section 11 and can be set to be the center on the total length in the front-back direction of the front body section 11. The center line C2 can also be set, for example, to be the center line in the width direction of the front body section 11. The height positions of the center position P2 and the center line C2 may be set to be any position and may bet set, for example, as the middle of the entire height of the rear body section 12.

The folding point position computing component 23 computes and derives the virtual folding point Px (see FIG. 5) on the basis of the position information of the center position P1 and the center line C1 of the rear body section 12 derived by the rear body attitude reading component 21 and the position information of the center position P2 and the center line C2 of the front body section 11 derived by the front body attitude computing component 22.

The movement prediction line computing component 24 computes and derives a smooth three-dimensional curve that links the center position P1 of the rear body section 12 and the center position P2 of the front body section 11, on the basis of the information related to the center position P1 of the rear body section 12, the position information related to the virtual folding point Px, and the information related to the center position P2 of the front body section 11. This line is a movement prediction line D1 (see FIG. 7A below) on which the tunnel excavation device 10 moves according to the current attitude.

The curve is a parametric curve in which the above-mentioned center position P1 of the rear body section 12, the center position P2 of the front body section 11, and the folding point Px server as three control points. The center line C1 of the rear body section 12 and the center line C2 of the front body section 11 are tangents to the curve. The parametric curve of the present embodiment is a secondary Bezier curve.

That is in the present embodiment, a precise three-dimensional arc track can be approximated with the center position P1 of the rear body section 12 serving as a first control point, the folding point Px serving as a second control point, and the center position P2 of the front body section 11 serving as a third control point. Accordingly, by using the second control point as the folding center, the track (target value) for a three-dimensional curvature radius R construction can be computed and derived with a one-dimensional parameter change.

The position calculating component 25 calculates a current positional deviation amount (Q1*f*, Q1*r*) and a target positional deviation amount (Q0*f*, Q0*r*).

The current positional deviation amount Q1*f* is a positional deviation amount from a first path line at the center position P2 of the front body section 11 derived by the rear body attitude reading component 21 and the front body attitude computing component 22 during tunneling, and also includes the direction of the positional deviation from the first path line. In addition, the current positional deviation amount Q1*f* is a positional deviation amount from a third path line at the center position P2 of the front body section 11 derived by the rear body attitude reading component 21 and the front body attitude computing component 22 during reverse travel, and also includes the direction of the positional deviation from the third path line.

The current positional deviation amount Qir is a positional deviation amount from a second path line at the center position P1 of the rear body section 12 derived by the rear body attitude reading component 21 during tunneling, and also includes the direction of the positional deviation from the second path line. In addition, the current positional deviation amount Qir is a positional deviation amount from the third path line at the center position P1 of the rear body section 12 derived by the rear body attitude reading component 21 during reverse travel, and also includes the direction of the positional deviation from the third path line.

The target positional deviation amount Q0*f* is a positional deviation amount from the first path line at a position where the front body section 11 is assumed to have traveled forward a predetermined distance along the movement prediction line D1 derived from the current attitude during tunneling. The target positional deviation amount Q0*f* is a positional deviation amount from the third path line at a position where the front body section 11 is assumed to have traveled in reverse a predetermined distance along the movement prediction line D1 derived from the current attitude during reverse travel.

The target positional deviation amount Q0*r* is a positional deviation amount from the second path line at a position where the rear body section 12 is assumed to have traveled forward a predetermined distance along the movement prediction line D1 derived from the current attitude during tunneling. The target positional deviation amount Q0*r* is a positional deviation amount from the third path line at a position where the rear body section 12 is assumed to have traveled in reverse a predetermined distance along the movement prediction line D1 derived from the current attitude during reverse travel.

The predetermined distance may have multiple settings and may be set to, for example, 50 cm or 1 m.

In the tunneling operation, the first path line is the excavating plan line of the tunnel. The excavating plan line (first path line) of the tunnel can be set, for example, as a line that connects positions that are on the vertical line of the center in the width direction of the planned tunnel and that are at the same height as the center position P2 of the front body section 11. In addition, because it is necessary that the rear body section 12 travels forward along the tunnel excavated by the front body section 11, the second path line is an actual result line of the front body section 11 that is actually excavated. The actual result line (second path line) can be set as a line on which the center position P2 of the front body section 11 has moved during the actual excavation.

Because there is a need to travel in reverse along the excavated tunnel when traveling in reverse, the third path line is the actual result line of the front body section 11 or the rear body section 12 that was actually excavated. The actual result line (third path line) can be set as a line on which the center position P2 of the front body section 11 or the center position P1 of the rear body section 12 has moved during the actual excavation.

When tunneling is selected by the operator, the position calculating component 25 calculates the current positional deviation amount Q1*f* that is the positional deviation amount from the first path line of the front body section 11 in the current state and the target positional deviation amount Q0*f* that is the positional deviation amount from the first path line when the front body section 11 has traveled forward the predetermined distance, and calculates the current positional deviation amount Qir that is the positional deviation amount from the second path line of the front body section 11 in the current state and the target positional deviation amount Q0*r* that is the positional deviation amount from the second path line when the rear body section 12 has traveled forward the predetermined distance.

When reverse travel is selected by the operator, the position calculating component 25 calculates the current positional deviation amount Qir that is the positional deviation amount from the third path line of the rear body section 12 in the current state and the target positional deviation amount Q0*r* that is the positional deviation amount from the third path line when the rear body section 12 has traveled in reverse the predetermined distance, and calculates the current positional deviation amount Q1*f* that is the positional deviation amount from the third path line of the front body section 11 in the current state and the target positional deviation amount Q0*f* that is the positional deviation amount from the third path line when the front body section 11 has traveled in reverse the predetermined distance.

The display control component 26 displays the positional deviation amounts calculated by the position calculating component 25 on the display input component 16.

When the tunneling operation is selected by the operator, the display control component 26 displays, on the display input component 16, the current positional deviation amount Q1*f* of the front body section 11 and the target positional deviation amount Q0*f* when the front body section 11 has traveled forward the predetermined distance calculated by the position calculating component 25, and displays, on the display input component 16, the current positional deviation amount Qir of the rear body section 12 and the target positional deviation amount Q0*r* when the rear body section 12 has traveled forward the predetermined distance calculated by the position calculating component 25.

When the reverse travel operation is selected by the operator, the display control component 26 displays, on the display input component 16, the current positional deviation amount Q1*f* of the front body section 11 and the target positional deviation amount Q0*f* when the front body section 11 has traveled in reverse the predetermined distance calculated by the position calculating component 25, and displays, on the display input component 16, the current positional deviation amount Qir of the rear body section 12 and the target positional deviation amount Q0*r* when the rear body section 12 has traveled in reverse the predetermined distance calculated by the position calculating component 25.

Although discussed below, based on the display of the deviation amounts of the positions on the excavating plan or the positions on the excavation actual result line on the display input component 16, the operator operates the display input component 16 so as to reduce the deviation amounts by operating the thrust cylinders 13*a* to 13*f*, and the movement prediction line D1 is computed again and the positional deviation amounts are also computed again and displayed.

The cylinder control component 27 controls the stroke amounts of the thrust cylinders 13*a* to 13*f* included in the linking mechanism 13 so that the front body section 11 or the rear body section 12 moves along the movement prediction line D1 derived according to the computing by the movement prediction line computing component 24.

When the operator selects an extension operation during tunneling, the cylinder control component 27 controls the thrust cylinders 13*a* to 13*f* and causes the front body section 11 to travel forward so that the center position P2 of the front body section 11 follows the movement prediction line D1.

When the operator selects the retraction operation during tunneling, the cylinder control component 27 controls the thrust cylinders 13*a* to 13*f* and causes the rear body section 12 to travel forward so that the center position P1 of the rear body section 12 follows the movement prediction line D1.

When the operator selects the extension operation during reverse travel, the cylinder control component 27 controls the thrust cylinders 13*a* to 13*f* and causes the rear body section 12 to travel in reverse so that the center position P1 of the rear body section 12 follows the movement prediction line D1.

When the operator selects the retraction operation during reverse travel, the cylinder control component 27 controls the thrust cylinders 13*a* to 13*f* and causes the front body section 11 to travel in reverse so that the center position P2 of the front body section 11 follows the movement prediction line D1.

(Display Input Component 16)

The display input component 16 is, for example, a touch panel-type monitor display screen. In the present embodiment, the display input component 16 is used as an interface for setting the movement prediction line.

A tunneling/reverse travel setting component 30, an attitude changing component 31, and a deviation amount display component 32 are displayed on the display input component 16.

Setting of tunneling or reverse travel of the tunnel excavation device 10 is performed by the operator with the tunneling/reverse travel setting component 30. The deviation amount display component 32 displays the deviation amount from the excavating plan line or the actual result line at the current position, and the deviation amount between a position where the tunnel excavation device 10 has traveled forward the predetermined distance along the movement prediction line and a position where the tunnel excavation device 10 has traveled forward the predetermined distance along the excavating plan line or the actual result line. A direction input component 43 for the operator to perform direction correction on the basis of the display of the deviation amount display component 32, is displayed on the attitude changing component 31.

(Tunneling/Reverse Travel Setting Component 30)

The tunneling/reverse travel setting component 30 is a switch for switching the movement direction (forward travel/reverse travel) of the tunnel excavation device 10 and enables setting of tunneling or reverse travel of the tunnel excavation device 10.

A tunneling button 41, a reverse travel button 42, and a cylinder operation component 44 for extending and retracting all of the thrust cylinders 13*a* to 13*f* are provided to the tunneling/reverse travel setting component 30.

The cylinder operation component 44 is an operation input component for setting the operation of the six thrust cylinders 13*a* to 13*f* included in the linking mechanism 13, and includes an extension button 44*a*, a stop button 44*b*, and a retraction button 44*c*.

The extension button 44*a* is operated when driving the thrust cylinders 13*a* to 13*f* in the extending direction.

The stop button 44*b* is operated when stopping the movement of the thrust cylinders 13*a* to 13*f*.

The retraction button 44*c* is operated when driving the thrust cylinders 13*a* to 13*f* in the retracting direction.

The tunneling button 41 is pressed when excavating the tunnel. While the grippers 12*a* of the rear body section 12 protrude outward and the rear body section 12 is secured to the shaft of the tunnel, the tunneling button 41 is pressed and then the extension button 44*a* of the cylinder operation component 44 is pressed, whereby the thrust cylinders 13*a* to 13*f* are extended and the front body section 11 travels forward so that the center position P2 of the front body section 11 follows the movement prediction line D1.

In addition, while the grippers 11*b* of the front body section 11 protrude outward and the front body section 11 is secured to the shaft of the tunnel, the tunneling button 41 is pressed and then the retraction button 44*c* of the cylinder operation component 44 is pressed, whereby the thrust cylinders 13*a* to 13*f* are retracted and the rear body section 12 travels forward so that the center position P1 of the rear body section 12 follows the movement prediction line D1.

The operation of the grippers 12*a* of the rear body section 12 and the grippers 11*b* of the front body section 11 are performed by the operator using an unillustrated operating component.

The reverse travel button 42 is pressed when traveling in reverse along the tunnel. While the grippers 11*b* of the front body section 11 protrude outward and the front body section 11 is secured to the shaft of the tunnel, the reverse travel button 42 is pressed and then the extension button 44*a* of the cylinder operation component 44 is pressed, whereby the thrust cylinders 13*a* to 13*f* are extended and the rear body section 12 travels in reverse so that the center position P1 of the rear body section 12 follows the movement prediction line D1.

While the grippers 12*a* of the rear body section 12 protrude outward and the rear body section 12 is secured to the shaft of the tunnel, the reverse travel button 42 is pressed and then the retraction button 44*c* of the cylinder operation component 44 is pressed, whereby the thrust cylinders 13*a* to 13*f* are retracted and the front body section 11 travels in reverse so that the center position P2 of the front body section 11 follows the movement prediction line D1.

(Attitude Changing Component 31)

The attitude changing component 31 includes a direction input component 43. The direction input component 43 is able to operate the thrust cylinders 13*a* to 13*f* move in the desired direction by operating the direction input component 43 in said direction.

The direction input component 43 is operated by the operator for correcting the attitude of the tunnel excavation device when a deviation in the forward travel or reverse travel toward a target position has occurred, and includes a plurality of direction buttons (upward button 43*a*, downward button 43*b*, rightward button 43*c*, and leftward button 43*d*).

The upward button 43*a*, the downward button 43*b*, the rightward button 43*c*, and the leftward button 43*d* are operated by the operator as buttons in the direction for reducing the deviation amount while the operator watches the deviation amount display component 32 and checks the occurrence of the deviation amount in any of the directions. As a result, the operator is able to control the tunnel excavation device 10 to tunnel in the direction of the excavating plan line or the actual result line by intuitively operating the buttons in the direction for eliminating the deviation amount while watching the deviation amount display component 32.

For example, when the extension button 44*a* has been pressed during a tunneling operation, when the leftward button 43*d* is operated, a predetermined thrust cylinder extends a small amount and the attitude is changed so that the front body section 11 bends, with respect to the rear body section 12, further leftward than the current state, and the front body section 11 travels forward. Additionally, when the retraction button 44*c* has been pressed during a tunneling operation, when the leftward button 43*d* is operated, a predetermined thrust cylinder retracts a small amount and the attitude is changed so that the rear body section 12 bends, with respect to the front body section 11, further leftward than the current state, and the rear body section 12 travels forward.

As indicated above, the operator is able to correct the movement prediction line D1 by correcting the attitude of the tunnel excavation device 10 by operating the direction input component 43 and the cylinder operation component 44 while watching the deviation amount display component 32.

(Deviation Amount Display Component 32)

The deviation amount display component 32 includes a front body deviation amount display component 45 and a rear body deviation amount display component 46. The front body deviation amount display component 45 displays the current positional deviation amount Q1*f* and the target positional deviation amount Q0*f* of the front body section 11 during tunneling and during reverse travel.

The rear body deviation amount display component 46 displays the current positional deviation amount Qir and the target positional deviation amount Q0*r* of the rear body section 12 during tunneling and during reverse travel.

(Display During Tunneling Operation)

Herein follows an explanation of the display of the front body deviation amount display component 45 and the rear body deviation amount display component 46 when the tunneling operation is set by the operator.

(Display of Front Body Deviation Amount Display Component 45 During Tunneling Operation)

The operator checks the display of the front body deviation amount display component 45 while the extension button 44*a* is pressed and the thrust cylinders 13*a* to 13*f* are extended during the tunneling operation brought about by pressing the tunneling button 41. While the grippers 12*a* of the rear body section 12 protrude outward and the rear body section 12 is secured to the shaft of the tunnel in the tunneling operation, when the extension button 44*a* is pressed, the thrust cylinders 13*a* to 13*f* extend whereby the front body section 11 travels forward and excavating is performed.

Figure 7A:
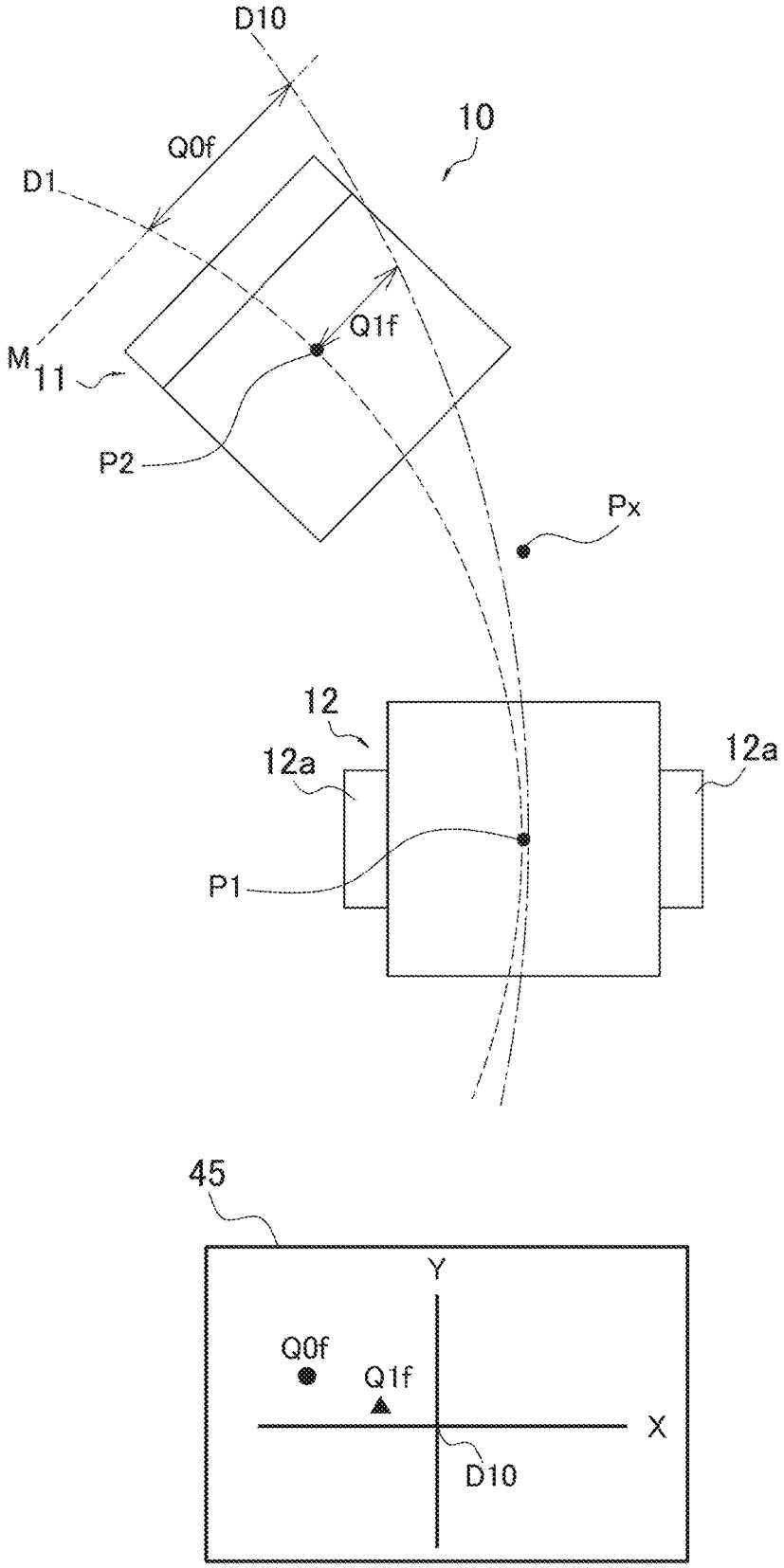
FIG. 7A is a diagram for explaining a display of a front body deviation amount display component during tunneling.

FIG. 7A is a schematic view for explaining the current positional deviation amount Q1*f* and the target positional deviation amount Q0*f*. The upper diagram depicts the attitude of the tunnel excavation device 10 and the lower diagram depicts the display on the front body deviation amount display component 45. In the upper diagram of FIG. 7A, a tunnel excavating plan line D10 is depicted with a chain line. The movement prediction line D1 calculated on the basis of the current attitude of the tunnel excavation device 10 is also depicted.

The current positional deviation amount Q1*f* in the tunneling operation is the deviation amount from the tunnel excavating plan line D10 at the center position P2 of the front body section 11 as illustrated in FIG. 7A. The current positional deviation amount Q1*f* includes a deviation amount in the horizontal direction and a deviation amount in the vertical direction.

The current positional deviation amount Q1*f* is the deviation amount in a direction perpendicular to the center line C2 (see FIG. 5) of the front body section 11 in the current attitude. The current positional deviation amount Q1*f* may also be a positional deviation amount from the excavating plan line D10 at the center position P2 of the front body section 11 in a direction perpendicular to a tangential direction of the excavating plan line D10.

Moreover, the current positional deviation amount Q1*f* is not limited to a positional deviation amount based on the center position P2 of the front body section 11, and may be, for example, based on a middle position in the width direction at the tip end or rear end of the front body section 11.

The target positional deviation amount Q0*f* is the deviation amount from the tunnel excavating plan line D10 at the center position P2 of the front body section 11 when it is assumed that the tunnel excavation device 10 has traveled forward a predetermined distance M along the movement prediction line D1 from the current position of the front body section 11. The target positional deviation amount Q0*f* includes a deviation amount in the horizontal direction and a deviation amount in the vertical direction. While the target positional deviation amount Q0*f* in FIG. 7A is set as the deviation amount in a direction perpendicular to the center line C2 in the current attitude of the front body section 11, the target positional deviation amount Q0*f* is not limited in this way and may be, for example, the deviation amount in a direction perpendicular to the center line C2 in the attitude of the front body section 11 in a state where the tunnel excavation device 10 is assumed to have traveled forward the predetermined distance M along the movement prediction line D1. The target positional deviation amount Q0*f* may also be a positional deviation amount from the excavating plan line D10 at the center position P2 of the front body section 11 when the tunnel excavation device 10 is assumed to have traveled forward the predetermined distance M, in a direction perpendicular to a tangential direction of the excavating plan line D10.

Moreover, while the target positional deviation amount Q0*f* is set as a positional deviation amount based on the center position P2 of the front body section 11, the target positional deviation amount Q0*f* is not limited in this way and may be, for example, based on a middle position in the width direction at the tip end or rear end of the front body section 11.

A horizontal line X and a vertical line Y are depicted in the front body deviation amount display component 45 and the intersection of XY is set as the tunnel excavating plan line D10 (also called a target point). The operator's seat is disposed further to the rear than the rear body section 12 as explained above, and the current positional deviation amount Q1*f* and the target positional deviation amount Q0*f* are displayed on the front body deviation amount display component 45 during tunneling when viewing the front body section 11 from the operator's seat. The current positional deviation amount Q1*f* is depicted as the black triangle and the target positional deviation amount Q0*f* is depicted as the black circle in the front body deviation amount display component 45. The operator is able to check, with the front body deviation amount display component 45, the current positional deviation amounts in the horizontal direction and the vertical direction and the positional deviation amounts in the horizontal direction and the vertical direction when the tunneling extension operation has been performed and the front body section 11 has traveled forward in the current attitude.

Figure 7B:
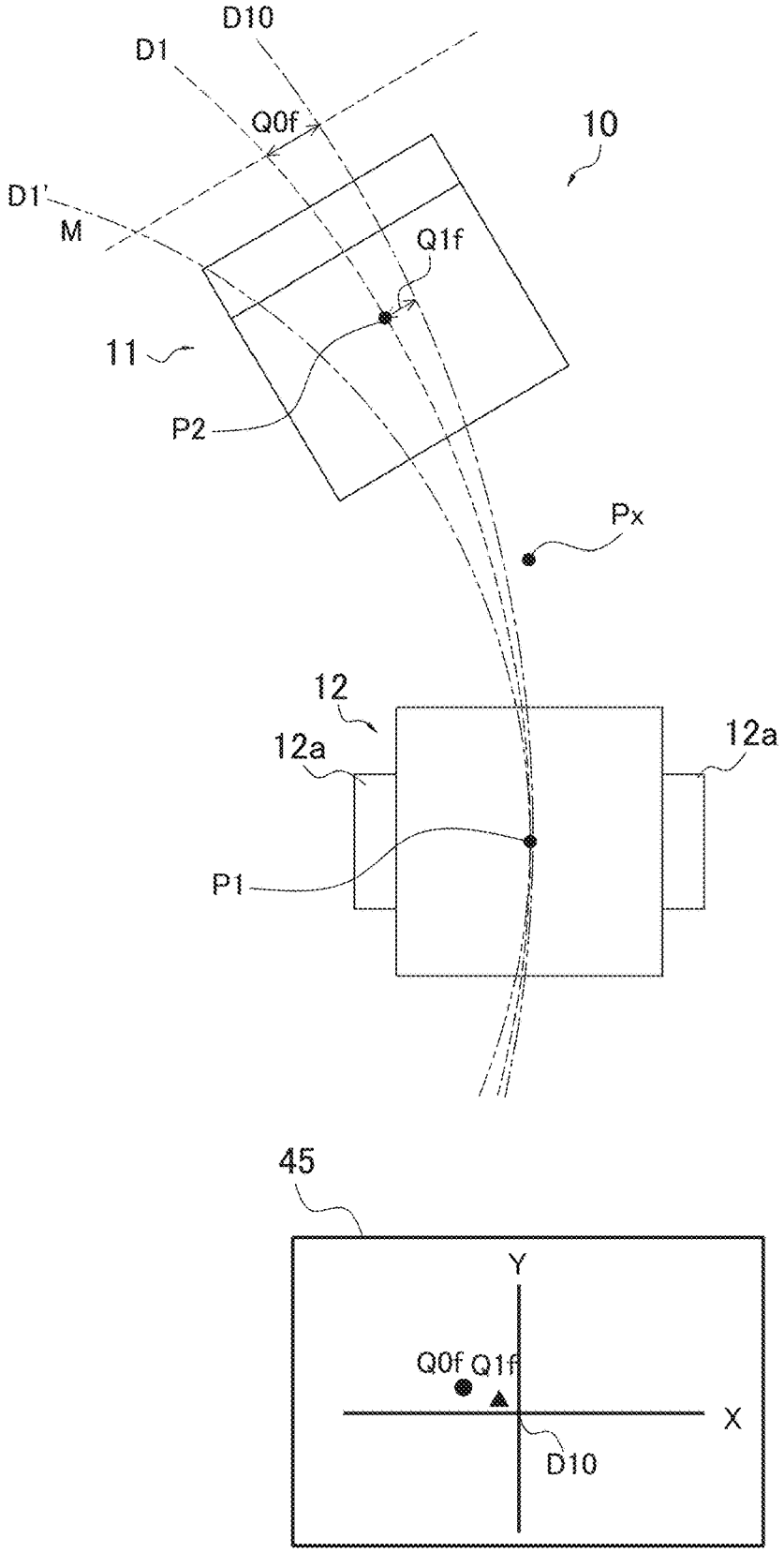
FIG. 7B is a diagram for explaining a display of the front body deviation amount display component during tunneling.

Next, the operator operates the attitude changing component 31 and changes the attitude of the tunnel excavation device 10. Specifically, as illustrated in the upper diagram in FIG. 7B, the bending to the left of the front body section 11 with respect to the rear body section 12 is reduced by pressing the rightward button 43*c* and operating the desired thrust cylinders among the thrust cylinders 13*a* to 13*f*. Consequently, a new movement prediction line D1 is created. FIG. 7B is a view illustrating a state in which the attitude of the front body section 11 has changed from FIG. 7A. The previous movement prediction line is depicted with a chain double-dashed line as D1' in FIG. 7B.

The deviation amount from the tunnel excavating plan line D10 at the position of the front body section 11 when it is assumed that the current front body section 11, the bending of which has been reduced, has traveled forward the predetermined distance M along the new movement prediction line D1, is calculated and serves as the new target positional deviation amount Q0*f*. In addition, the new current positional deviation amount Q1*f* is calculated because the position and attitude of the front body section 11 have changed.

The operator is able to check, on the basis of the display of the front body deviation amount display component 45 depicted in the lower diagram in FIG. 7B, whether the attitude has been corrected so as to approach the tunnel excavating plan line D10 due to the correction of the attitude of the tunnel excavation device 10. When it is determined that the correction amount is insufficient, settings can be made to change the attitude changing component 31 again so as to approach the tunnel excavating plan line D10.

Consequently, even when the curve is sharp, the front body section 11 can be made to travel forward along the excavated and formed tunnel excavating plan line D10.

(Display of the Rear Body Deviation Amount Display Component 46 During Tunneling Operation)

The operator checks the display of the rear body deviation amount display component 46 while the retraction button 44*c* is pressed and the thrust cylinders 13*a* to 13*f* are retracted during the tunneling operation brought about by pressing the tunneling button 41. When the retraction button 44*c* is pressed while the grippers 11*b* of the front body section 11 protrude outward and the front body section 11 is secured to the shaft of the tunnel in the tunneling operation, the thrust cylinders 13*a* to 13*f* are retracted and the rear body section 12 travels forward.

Figure 8A:
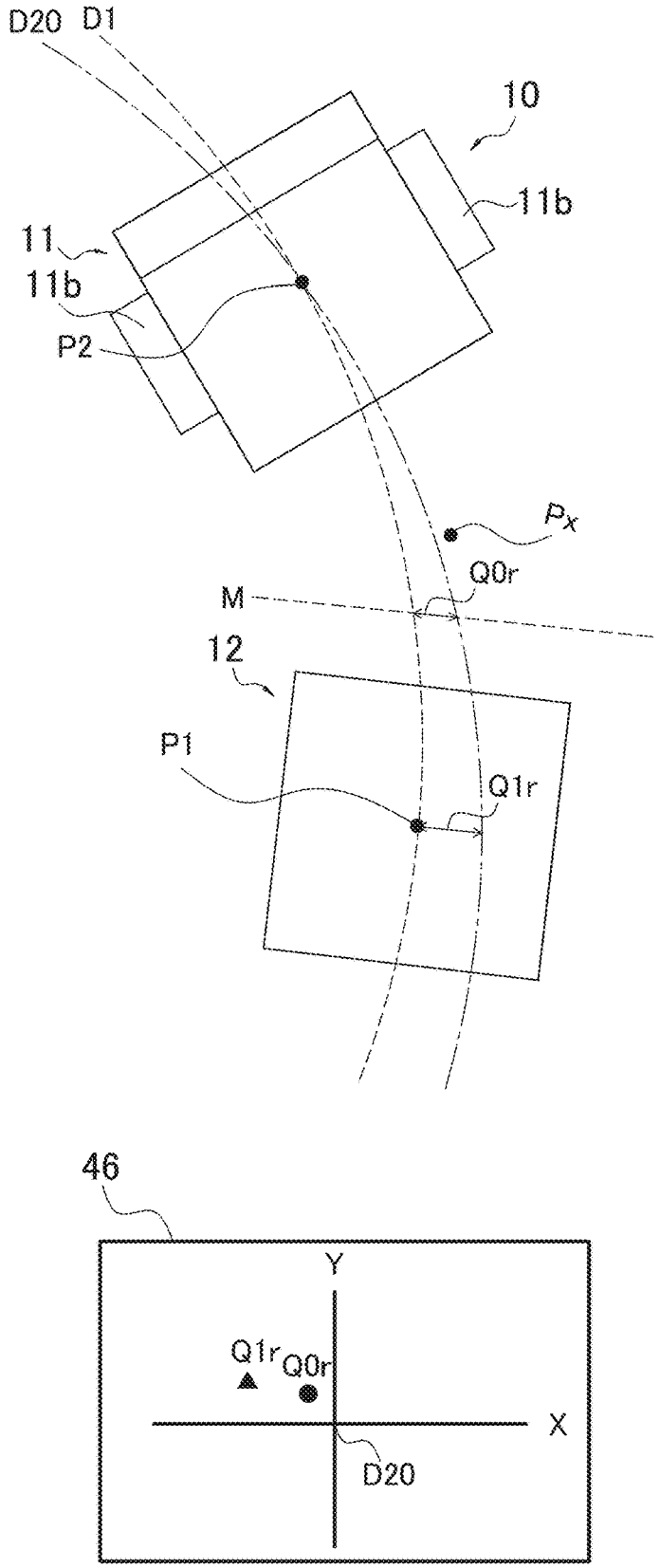
FIG. 8A is a diagram for explaining a display of a rear body deviation amount display component during tunneling.

FIG. 8A is a schematic view for explaining the current positional deviation amount Qir and the target positional deviation amount Q0*r*. The upper diagram depicts the attitude of the tunnel excavation device 10 and the lower diagram depicts the display on the rear body deviation amount display component 46. In the upper diagram of FIG. 8A, an actual result line D20 is depicted with a chain line.

The movement prediction line D1 calculated on the basis of the current attitude of the tunnel excavation device 10 is also depicted.

The actual result line D20 is a line that the front body section 11 has actually passed over and matches the center line of the excavated tunnel.

The current positional deviation amount Qir in the tunneling operation is the deviation amount from the actual result line D20 at the center position P1 of the rear body section 12 as illustrated in FIG. 8A. The current positional deviation amount Qir includes a deviation amount in the horizontal direction and a deviation amount in the vertical direction.

The current positional deviation amount Qir is the deviation amount in a direction perpendicular to the center line C1 (see FIG. 5) of the rear body section 12 in the current attitude. The current positional deviation amount Qir may be a positional deviation amount from the actual result line D20 at the center position P1 of the rear body section 12 in a direction perpendicular to a tangential direction of the actual result line D20.

Moreover, the current positional deviation amount Qir is not limited to a positional deviation amount based on the center position P1 of the rear body section 12, and may be, for example, based on a middle position in the width direction at the tip end or rear end of the rear body section 12.

The target positional deviation amount Q0*r* in the tunneling operation is the deviation amount from the actual result line D20 at the center position P1 of the rear body section 12 when it is assumed that the rear body section 12 has traveled forward the predetermined distance M along the movement prediction line D1 from the current rear body section 12. The target positional deviation amount Q0*r* includes the deviation amount in the horizontal direction and the deviation amount in the vertical direction. While the target positional deviation amount Q0*r* in FIG. 8A is set as the deviation amount in a direction perpendicular to the center line C1 in the current attitude of the rear body section 12, the target positional deviation amount Q0*r* is not limited in this way and may be, for example, the deviation amount in a direction perpendicular to the center line C1 in the attitude of the rear body section 12 in a state where the rear body section 12 is assumed to have traveled forward the predetermined distance M along the movement prediction line D1. The target positional deviation amount Q0*r* may be a positional deviation amount from the actual result line D20 at the center position P1 of the rear body section 12 that has assumed to have traveled forward the predetermined distance M, in a direction perpendicular to a tangential direction of the actual result line D20.

Moreover, while the target positional deviation amount Q0*r* is described as the positional deviation amount based on the center position P1 of the rear body section 12, the target positional deviation amount Q0*r* is not limited in this way and may be, for example, based on a middle position in the width direction at the tip end or rear end of the rear body section 12.

A horizontal line X and a vertical line Y are depicted in the rear body deviation amount display component 46 and the XY intersection is set as the actual result line D20 (also called a target point). The operator's seat is disposed further to the rear than the rear body section 12 as explained above, and the current positional deviation amount Qir and the target positional deviation amount Q0*r* are displayed on the rear body deviation amount display component 46 during tunneling when viewing the rear body section 12 from the operator's seat. The current positional deviation amount Qir is depicted as the black triangle and the target positional deviation amount Q0*r* is depicted as the black circle in the rear body deviation amount display component 46. The operator is able to check, with the rear body deviation amount display component 46, the current positional deviation amounts in the horizontal direction and the vertical direction and the positional deviation amounts in the horizontal direction and the vertical direction when the tunneling retraction operation has been performed and the rear body section 12 has traveled forward with the current attitude.

Figure 8B:
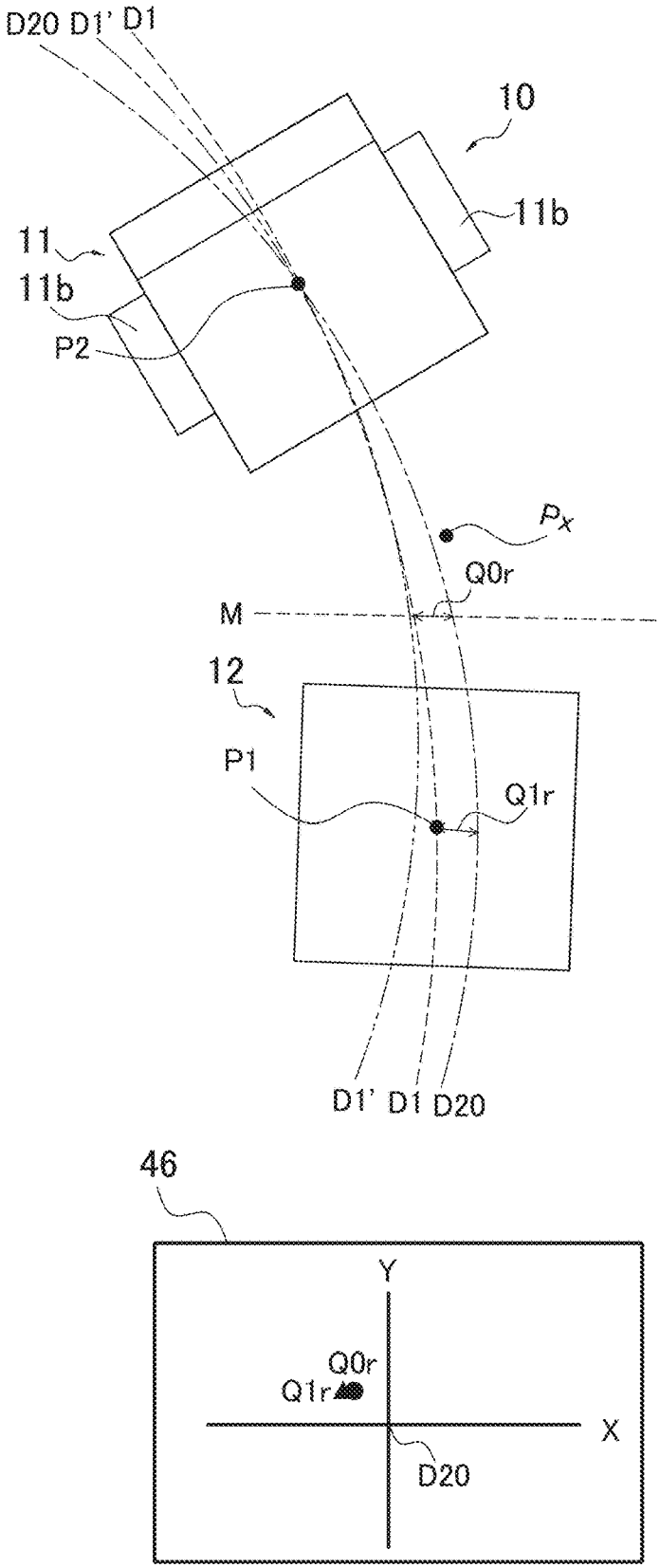
FIG. 8B is a diagram for explaining a display of the rear body deviation amount display component during tunneling.

Next, the operator operates the attitude changing component 31 and changes the attitude of the tunnel excavation device 10. Specifically, as illustrated in the upper diagram in FIG. 8B, the bending to the left of the rear body section 12 with respect to the front body section 11 is reduced by pressing the rightward button 43*c* and operating the desired thrust cylinders among the thrust cylinders 13*a* to 13*f*. Consequently, a new movement prediction line D1 is created. FIG. 8B is a view of a state in which the attitude of the rear body section 12 has changed from that of FIG. 8A. The previous movement prediction line is depicted with a chain double-dashed line as D1' in FIG. 8B.

The deviation amount from the tunnel excavating plan line D10 at the position of the rear body section 12 when it is assumed that the current rear body section 12, the bending of which has been reduced, has traveled forward the predetermined distance M along the new movement prediction line D1, is calculated and serves as the new target positional deviation amount Q0*r*. In addition, the new current positional deviation amount Qir is computed because the position and attitude of the rear body section 12 have changed.

The operator is able to check, on the basis of the display of the rear body deviation amount display component 46 depicted in the lower diagram in FIG. 8B, whether the attitude has been corrected so as to approach the actual result line D20 due to the correction of the attitude of the tunnel excavation device 10. When it is determined that the correction amount is insufficient, settings can be made to change the attitude changing component 31 again so as to approach the actual result line D20.

Consequently, even when the curve is sharp, the rear body section 12 can be made to travel forward along the excavated and formed tunnel shaft.

While only the front body deviation amount display component 45 is depicted in FIGS. 7A and 7B and only the rear body deviation amount display component 46 is depicted in FIGS. 8A and 8B, both display components are displayed at the same time and both can be changed by setting of the movement prediction line D1.

While pressing the rightward button 43*c* and correcting of the positional deviation in the horizontal direction is explained as an example in FIGS. 7B and 8B, the positional deviation not only in the horizontal direction but also in the vertical direction can be corrected by pressing the upward button 43*a* or the downward button 43*b*.

(Display of Reverse Travel Operation)

Herein follows an explanation of the display of the front body deviation amount display component 45 and the rear body deviation amount display component 46 when the reverse travel operation is set by the operator.

(Display of the Rear Body Deviation Amount Display Component 46 During Reverse Travel Operation)

The operator checks the display of the rear body deviation amount display component 46 while the extension button 44*a* is pressed and the thrust cylinders 13*a* to 13*f* are made to extend during the reverse travel operation brought about by pressing the reverse travel button 42. When the extension button 44*a* is pressed while the grippers 11*b* of the front body section 11 protrude outward and the front body section 11 is secured to the shaft of the tunnel in the reverse travel operation, the thrust cylinders 13*a* to 13*f* extend whereby the rear body section 12 travels in reverse.

Figure 9A:
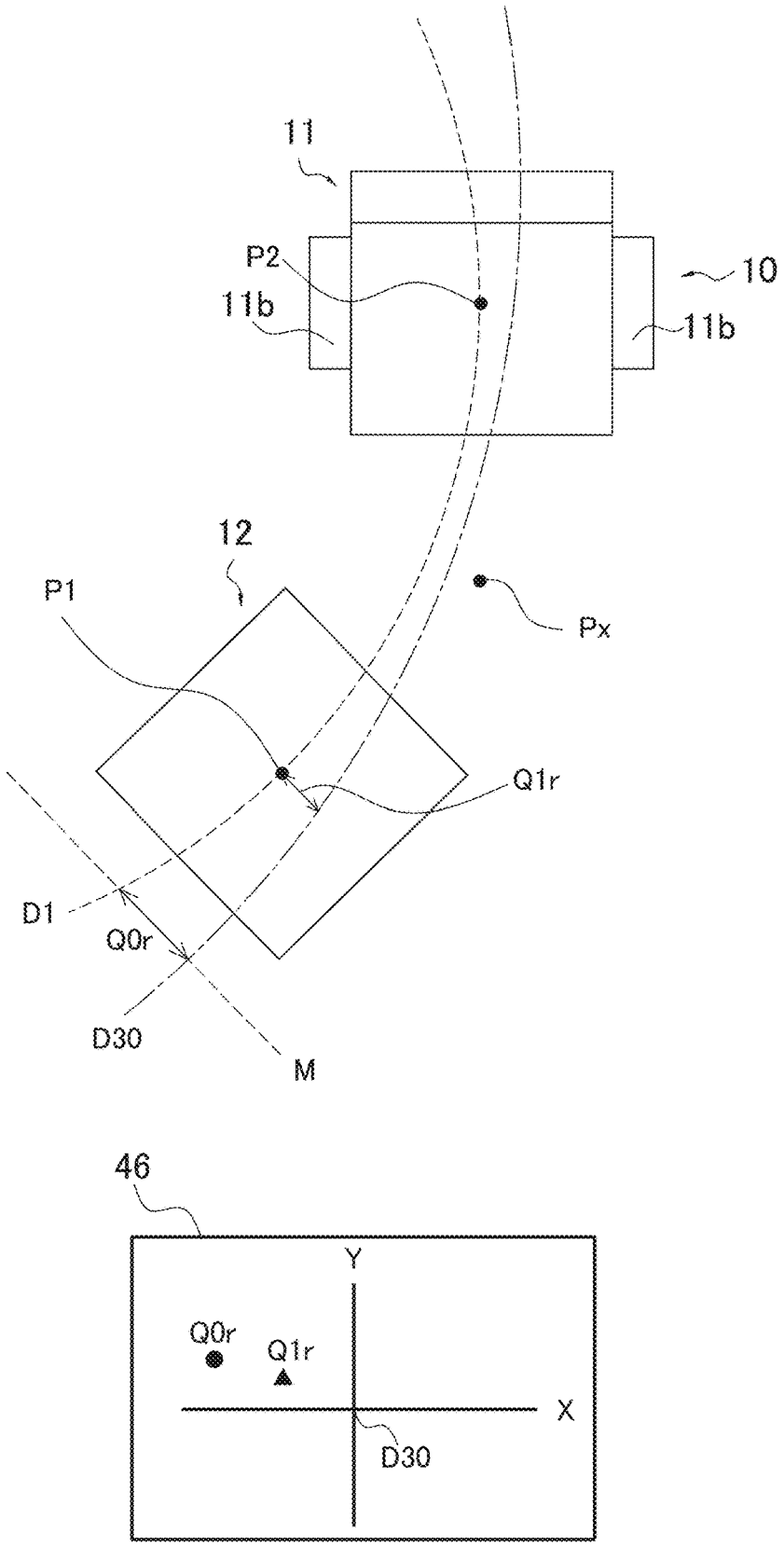
FIG. 9A is a diagram for explaining a display of the rear body deviation amount display component during reverse travel.

FIG. 9A is a schematic view for explaining the current positional deviation amount Qir and the target positional deviation amount Q0*r*. The upper diagram depicts the attitude of the tunnel excavation device 10 and the lower diagram depicts the display on the rear body deviation amount display component 46. An actual result line D30 is depicted as a chain line in the upper diagram of FIG. 9. The movement prediction line D1 calculated on the basis of the current attitude of the tunnel excavation device 10 is also depicted.

The actual result line D30 is the line that the front body section 11 or the rear body section 12 has actually passed over and matches the center line of the excavated tunnel.

The current positional deviation amount Qir in the reverse travel operation is the deviation amount from the actual result line D30 at the center position P1 of the rear body section 12 as illustrated in FIG. 9A. The current positional deviation amount Qir includes the deviation amount in the horizontal direction and the deviation amount in the vertical direction. The current positional deviation amount Qir is the deviation amount in a direction perpendicular to the center line C1 (see FIG. 5) of the rear body section 12 in the current attitude. The current positional deviation amount Qir may be a positional deviation amount from the actual result line D30 at the center position P1 of the rear body section 12 in a direction perpendicular to a tangential direction of the actual result line D30.

Moreover, the current positional deviation amount Qir is not limited to a positional deviation amount based on the center position P1 of the rear body section 12, and may be, for example, based on a middle position in the width direction at the tip end or rear end of the rear body section 12.

The target positional deviation amount Q0*r* in the reverse travel operation is the deviation amount from the actual result line D30 at the center position P1 of the rear body section 12 when it is assumed that the rear body section 12 has traveled in reverse the predetermined distance M along the movement prediction line D1 from the current rear body section 12. The target positional deviation amount Q0*r* includes the deviation amount in the horizontal direction and the deviation amount in the vertical direction. While the target positional deviation amount Q0*r* in FIG. 9A is set as the deviation amount in a direction perpendicular to the center line C1 in the current attitude of the rear body section 12, the target positional deviation amount Q0*r* is not limited in this way and may be, for example, the deviation amount in a direction perpendicular to the center line C1 in the attitude of the rear body section 12 in a state where the rear body section 12 is assumed to have traveled in reverse the predetermined distance M along the movement prediction line D1. The target positional deviation amount Q0*r* may also be a positional deviation amount from the actual result line D30 at the center position P1 of the rear body section 12 when it is assumed that the rear body section 12 has traveled in reverse the predetermined distance M, in a direction perpendicular to a tangential direction of the actual result line D30.

Moreover, the target positional deviation amount Q0*r* is obtained by deriving the positional deviation amount based on the center position P1 of the rear body section 12, but the target positional deviation amount Q0*r* is not limited in this way and may be, for example, based on a middle position in the width direction at the tip end or rear end of the rear body section 12.

A horizontal line X and a vertical line Y are depicted in the rear body deviation amount display component 46 and the XY intersection is set as the actual result line D30 (also called a target point). The operator's seat is disposed further to the rear than the rear body section 12 as explained above, and the current positional deviation amount Qir and the target positional deviation amount Q0*r* are displayed on the rear body deviation amount display component 46 during reverse travel when viewing the rear body section 12 from the operator's seat. The current positional deviation amount Qir is depicted as the black triangle and the target positional deviation amount Q0*r* is depicted as the black circle in the rear body deviation amount display component 46. The operator is able to check, with the rear body deviation amount display component 46, the current positional deviation amounts in the horizontal direction and the vertical direction and the positional deviation amounts in the horizontal direction and the vertical direction when the reverse travel extending operation has been performed and the rear body section 12 traveled in reverse with the current attitude.

Figure 9B:
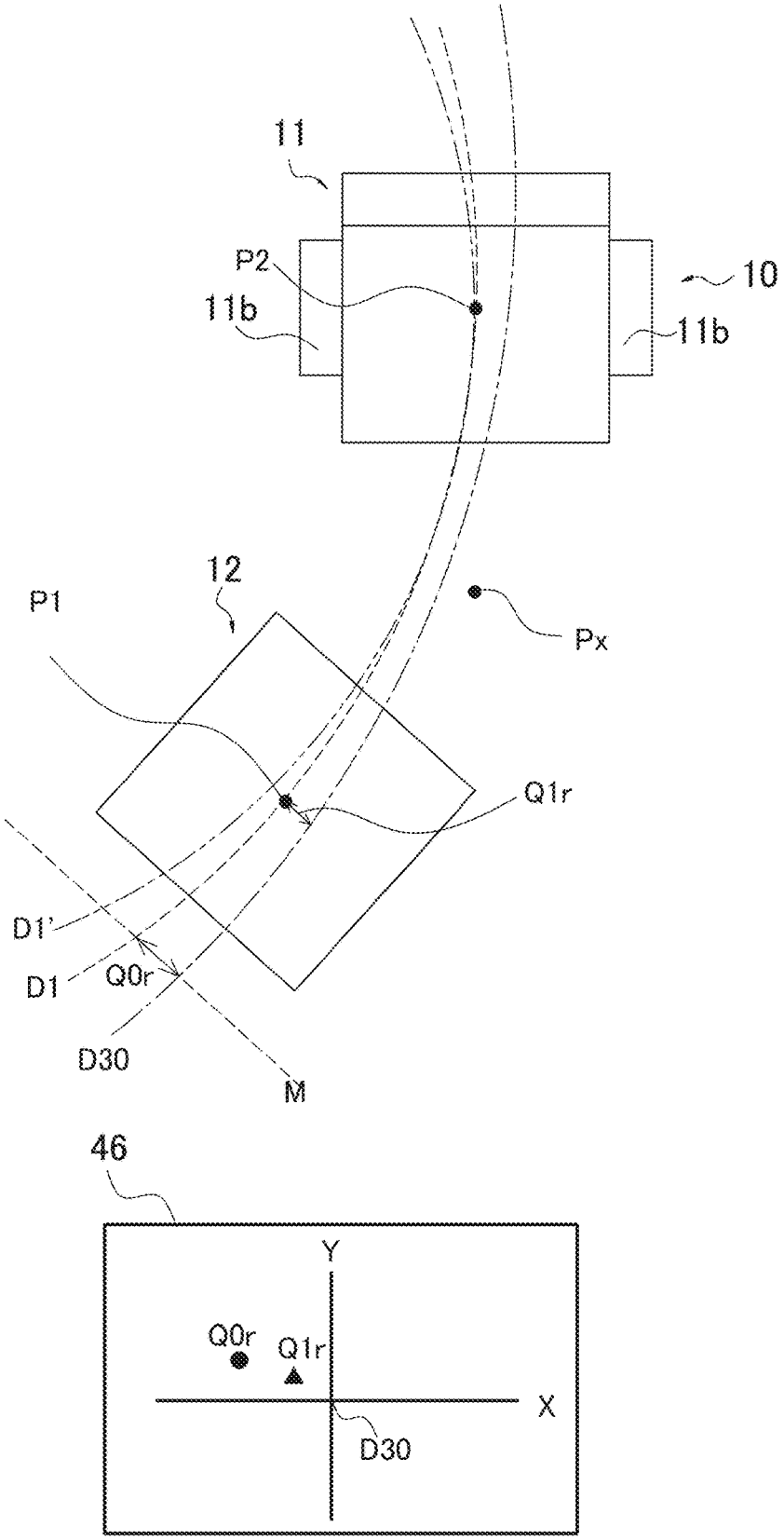
FIG. 9B is a diagram for explaining a display of the rear body deviation amount display component during reverse travel.

Next, the operator operates the attitude changing component 31 and changes the attitude of the tunnel excavation device 10. Specifically, as illustrated in the upper diagram in FIG. 9B, the bending of the rear body section 12 with respect to the front body section 11 is reduced by pressing the rightward button 43*c* and operating the desired thrust cylinders among the thrust cylinders 13*a* to 13*f*. Consequently, a new movement prediction line D1 is created. FIG. 9B is a view illustrating a state in which the attitude of the rear body section 12 has changed from FIG. 9A. The previous movement prediction line is depicted with a chain double-dashed line as D1' in FIG. 9B.

The deviation amount from the actual result line D30 at the position of the rear body section 12 when it is assumed that the current rear body section 12, the bending of which has been reduced, has traveled in reverse the predetermined distance M along the new movement prediction line D1, is computed and serves as the new target positional deviation amount Q0*r*. In addition, a new current positional deviation amount Qir is computed because the position and attitude of the rear body section 12 have changed.

The operator is able to check, on the basis of the display of the rear body deviation amount display component 46 depicted in the lower diagram in FIG. 9B, whether the attitude has been corrected to approach the actual result line D30 due to the correction of the attitude of the tunnel excavation device 10. When it is determined that the correction amount is insufficient, settings can be made to change the attitude changing component 31 again so as to approach the actual result line D30.

Consequently, even when the curve is sharp, the rear body section 12 can be made to travel in reverse along the excavated and formed tunnel shaft.

(Display of Front Body Deviation Amount Display Component 45 During Reverse Travel Operation)

The operator checks the display of the front body deviation amount display component 45 while the retraction button 44*c* is pressed and the thrust cylinders 13*a* to 13*f* are made to retract during the reverse travel operation brought about by pressing the reverse travel button 42. When the retraction button 44*c* is pressed while the grippers 12*a* of the rear body section 12 protrude outward and the rear body section 12 is secured to the shaft of the tunnel in the reverse travel operation, the thrust cylinders 13*a* to 13*f* retract whereby the front body section 11 travels in reverse.

Figure 10A:
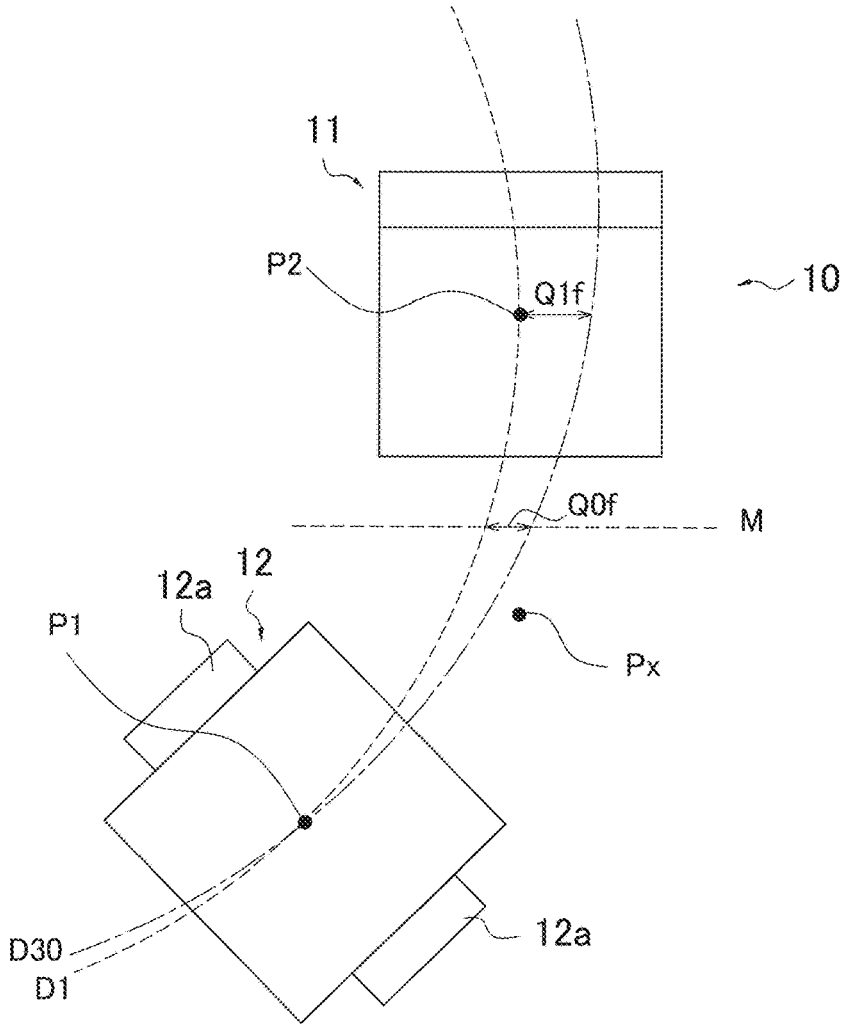
FIG. 10A is a diagram for explaining a display of the front body deviation amount display component during reverse travel.
Figure 10A:
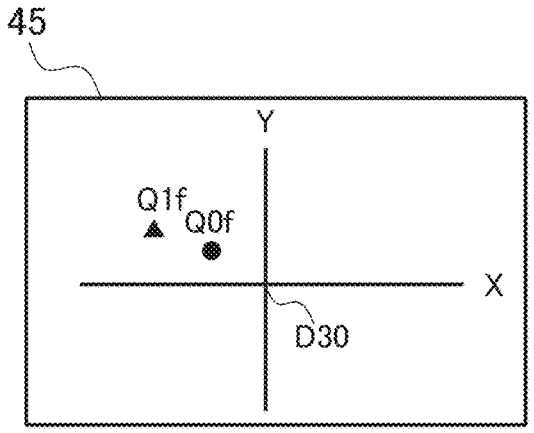

FIG. 10A is a schematic view for explaining the current positional deviation amount Q1*f* and the target positional deviation amount Q0*f*. The upper diagram depicts the attitude of the tunnel excavation device 10 and the lower diagram depicts the display on the front body deviation amount display component 45. The actual result line D30 is depicted as a chain line in the upper diagram of FIG. 10A. The movement prediction line D1 calculated on the basis of the current attitude of the tunnel excavation device 10 is also depicted.

The actual result line D30 is the line that the front body section 11 or the rear body section 12 has actually passed over and matches the center line of the excavated tunnel.

The current positional deviation amount Q1*f* in the reverse travel operation is the deviation amount from the actual result line D30 at the center position P2 of the front body section 11 as illustrated in FIG. 10A. The current positional deviation amount Q1*f* includes the deviation amount in the horizontal direction and the deviation amount in the vertical direction. The current positional deviation amount Q1*f* is the deviation amount in a direction perpendicular to the center line C2 (see FIG. 5) of the front body section 11 in the current attitude. The current positional deviation amount Q1*f* may be a positional deviation amount from the actual result line D30 at the center position P2 of the front body section 11 in a direction perpendicular to a tangential direction of the actual result line D30.

Moreover, the current positional deviation amount Q1*f* is not limited to the positional deviation amount based on the center position P2 of the front body section 11, and may be, for example, based on a middle position in the width direction at the tip end or rear end of the front body section 11.

The target positional deviation amount Q0*f* in the reverse travel operation is the deviation amount from the actual result line D30 at the center position P2 of the front body section 11 when it is assumed that the front body section 11 has traveled forward the predetermined distance M along the movement prediction line D1 from the current front body section 11. The target positional deviation amount Q0*f* includes the deviation amount in the horizontal direction and the deviation amount in the vertical direction. While the target positional deviation amount Q0*f* in FIG. 10A is set as the deviation amount in a direction perpendicular to the center line C2 in the current attitude of the front body section 11, the target positional deviation amount Q0*f* is not limited in this way and may be, for example, the deviation amount in a direction perpendicular to the center line C2 in the attitude of the front body section 11 in a state where the front body section 11 is assumed to have traveled forward the predetermined distance M along the movement prediction line D1. The target positional deviation amount Q0*f* may also be a positional deviation amount from the actual result line D30 at the center position P2 of the front body section 11 when it is assumed that the front body section 11 has traveled in reverse the predetermined distance M, in a direction perpendicular to a tangential direction of the actual result line D30.

Moreover, while the target positional deviation amount Q0*f* is obtained by deriving the positional deviation amount based on the center position P2 of the front body section 11, the target positional deviation amount Q0*f* is not limited in this way and may be, for example, based on a middle position in the width direction at the tip end or rear end of the front body section 11.

A horizontal line X and a vertical line Y are depicted in the front body deviation amount display component 45 and the intersection of XY is set as a target point. The operator's seat is disposed further to the rear than the rear body section 12 as explained above, and the current positional deviation amount Q1*f* and the target positional deviation amount Q0*f* are displayed on the front body deviation amount display component 45 during reverse travel when viewing the front body section 11 from the operator's seat. The current positional deviation amount Q1*f* is depicted as the black triangle and the target positional deviation amount Q0*f* is depicted as the black circle in the front body deviation amount display component 45. The operator is able to check, with the front body deviation amount display component 45, the current positional deviation amounts in the horizontal direction and the vertical direction and the positional deviation amounts in the horizontal direction and the vertical direction when the reverse travel retraction operation has been performed and the front body section 11 traveled in reverse with the current attitude.

Figure 10B:
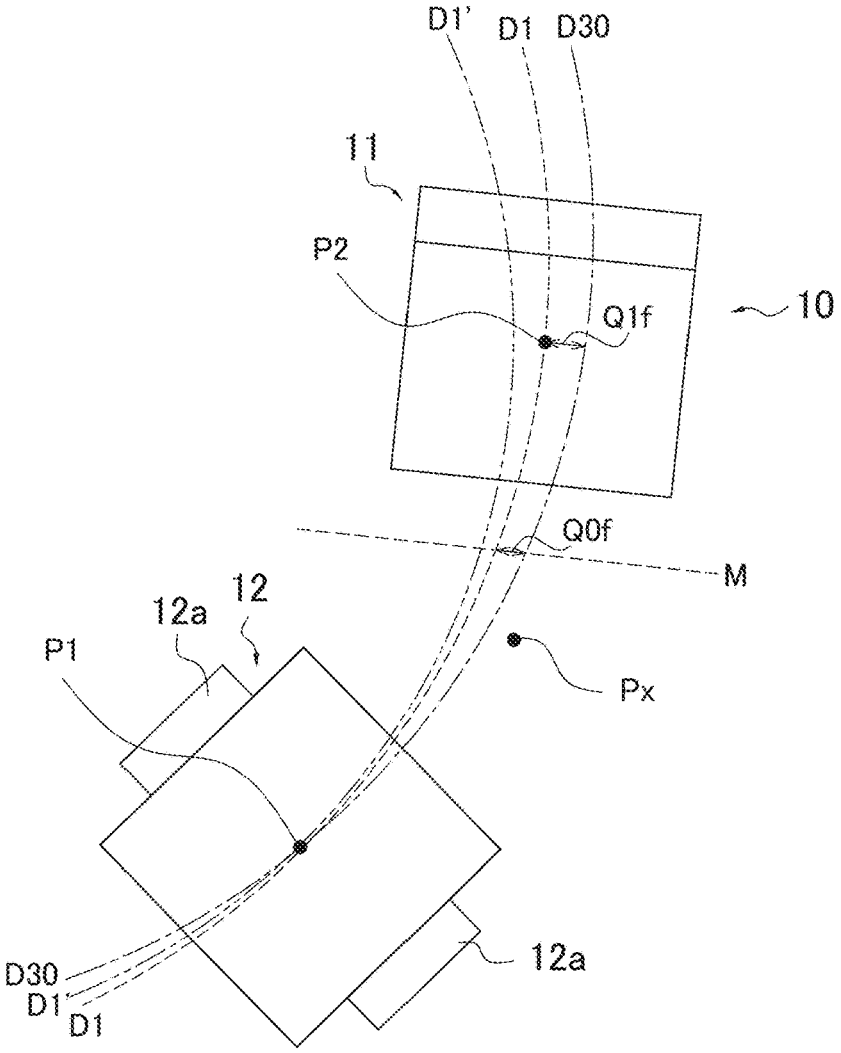
FIG. 10B is a diagram for explaining a display of the front body deviation amount display component during reverse travel.
Figure 10B:
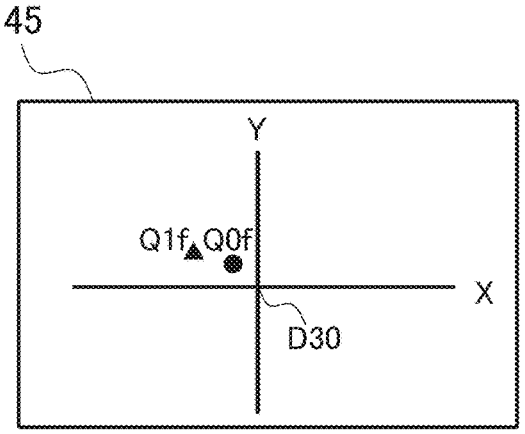

Next, the operator operates the attitude changing component 31 and changes the attitude of the tunnel excavation device 10. Specifically, as illustrated in the upper diagram in FIG. 10B, the bending of the front body section 11 with respect to the rear body section 12 is reduced by pressing the rightward button 43*c* and operating the desired thrust cylinders among the thrust cylinders 13*a* to 13*f*. Consequently, a new movement prediction line D1 is created. FIG. 10B is a view illustrating a state in which the attitude of the front body section 11 has changed from FIG. 10A. The previous movement prediction line is depicted with a chain double-dashed line as D1' in FIG. 10B.

The deviation amount from the actual result line D30 at the position of the front body section 11 when it is assumed that the current front body section 11, the bending of which has been reduced, has traveled forward the predetermined distance M along the new movement prediction line D1, is computed and serves as the new target positional deviation amount Q0*f*. In addition, the new current positional deviation amount Q1*f* is computed because the position and attitude of the front body section 11 have changed.

The operator is able to check, on the basis of the display of the front body deviation amount display component 45 depicted in the lower diagram in FIG. 10B, whether the attitude has been corrected so as to approach the actual result line D30 due to the change of the attitude of the tunnel excavation device 10. When it is determined that the correction amount is insufficient, settings can be made to change the attitude changing component 31 again so as to approach the actual result line D30.

Consequently, even when the curve is sharp, the front body section 11 can be made to travel in reverse along the excavated and formed tunnel shaft.

While only the front body deviation amount display component 45 is depicted in FIGS. 9A and 9B and only the rear body deviation amount display component 46 is depicted in FIGS. 10A and 10B, both display components are displayed at the same time and both displays can be displayed by correcting the attitude.

While pressing the rightward button 43*c* and correcting of the positional deviation in the horizontal direction is explained as an example in FIGS. 9B and 10B, the positional deviation not only in the horizontal direction but also in the vertical direction can be corrected by pressing the upward button 43*a* or the downward button 43*b*.

<Operations>

Herein follows an explanation of the operations of the tunnel excavation device 10 and also a method for controlling the tunnel excavation device 10 according to an embodiment of the present disclosure.

(Operation During Tunneling)

Figure 11:
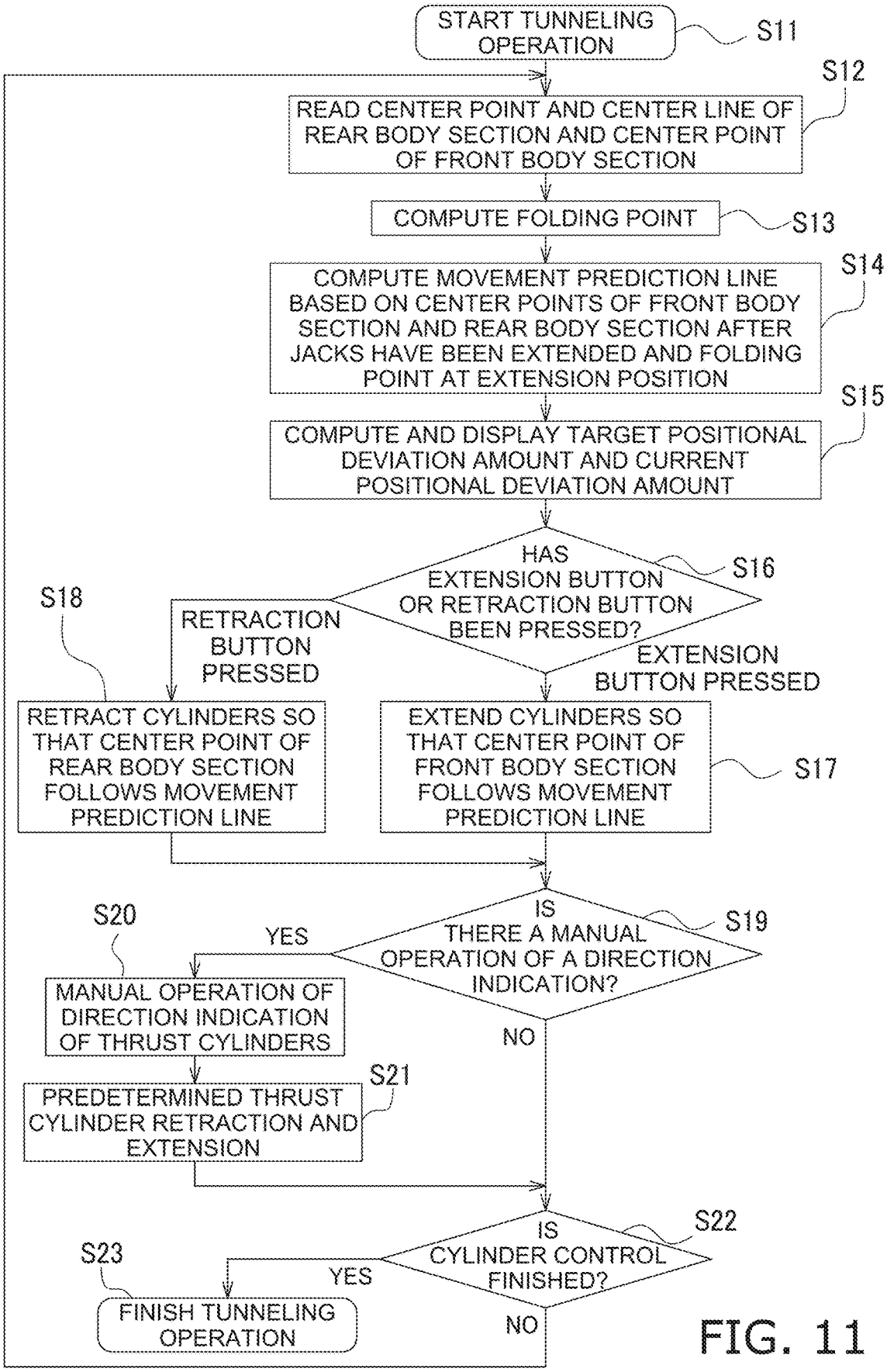
FIG. 11 is a flow chart illustrating a control operation during tunneling of the tunnel excavation device in FIG. 1.

FIG. 11 is a flow chart illustrating a control operation of the tunnel excavation device 10 during a tunneling operation.

The tunneling operation is started at step S11 when the tunneling button 41 is pressed by the operator.

Next, in step S12, the rear body attitude reading component 21 derives the center position P1 and the center line C1 (orientation) of the rear body section 12 (see FIG. 4). The center position P1 and the center line C1 of the rear body section 12 can be derived by surveying using, for example, a total station (not illustrated) or derived using an attitude sensor or the like provided to the rear body section 12.

In step S12, the front body attitude computing component 22 computes the center position P2 and attitude (center line C2) of the front body section 11 with respect to the rear body section 12 on the basis of the position information and the attitude of the center position P1 and the center line C1 of the rear body section 12 derived by the rear body attitude reading component 21 and the stroke amounts of the thrust cylinders 13*a* to 13*f*.

Next in step S13, the folding point position computing component 23 computes and derives the virtual folding point Px (see FIG. 4) on the basis of the position information of the center position P1 and the center line C1 of the rear body section 12 derived by the rear body attitude reading component 21 and the position information of the center position P2 and the center line C2 of the front body section 11 derived by the front body attitude computing component 22.

Next in step S14, the movement prediction line computing component 24 computes and derives the smooth movement prediction line D1 that links the center position P1 of the rear body section 12 and the center position P2 of the front body section 11, on the basis of the information related to the center position P1 of the rear body section 12, the position information related to the virtual folding point Px, and the information related to the center position P2 of the front body section 11.

Next in step S15, the position calculating component 25 calculates the current positional deviation amount Q1*f* and the target positional deviation amount Q0*f* of the front body section 11 with respect to the excavating plan line D10, and calculates the current positional deviation amount Qir and the target positional deviation amount Q0*r* of the rear body section 12 with respect to the actual result line D20. The display control component 26 then displays the current positional deviation amount Q1*f* and the target positional deviation amount Q0*f* on the front body deviation amount display component 45 as illustrated in FIG. 7A, and displays the current positional deviation amount Qir and the target positional deviation amount Q0*r* on the rear body deviation amount display component 46 as illustrated in FIG. 8A.

Next in step S16, the controller 15 determines whether the extension button 44*a* has been pressed or the retraction button 44*c* has been pressed. When the extension button 44*a* has been pressed while the grippers 12*a* of the rear body section 12 protrude outward and the rear body section 12 is secured to the tunnel shaft, the control advances to step S17. In step S17, the thrust cylinders 13*a* to 13*f* are extended so that the center position P2 of the front body section 11 follows the most recent movement prediction line D1. The most recent movement prediction line D1 indicates the movement prediction line D1 calculated on the basis of the most recently changed attitude when the attitude has been repeatedly changed in the below-mentioned steps S19-S21. When the attitude has not changed even once in step S19, that is when the controls of steps S20 and S21 have not been performed, the original movement prediction line D1 serves as the most recent movement prediction line D1.

In step S16, when the retraction button 44*c* has been pressed while the grippers 11*b* of the front body section 11 protrude outward and the front body section 11 is secured to the tunnel shaft, the control advances to step S18. In step S18, the thrust cylinders 13*a* to 13*f* are retracted so that the center position P1 of the rear body section 12 follows the most recent movement prediction line D1.

Next in step S19, the controller 15 determines whether the direction input component 43 of the attitude changing component 31 has been operated by the operator. The operator checks the display of the front body deviation amount display component 45 and determines whether it is necessary to change the attitude of the tunnel excavation device 10, and operates the attitude changing component 31 when it is determined that the deviation amount is large and it is necessary to change the attitude.

When it is determined that there has been an operation by the operator in step S19, a direction command manual operation of the thrust cylinders 13*a* to 13*f* is inputted in step S20 and the predetermined thrust cylinders 13*a* to 13*f* are retracted a small amount in step S21.

Next, the control advances to step S22 and the controller 15 determines whether the control of the thrust cylinders 13*a* to 13*f* in step S17 or step S18 is finished.

When it is determined that the control of the thrust cylinders 13*a* to 13*f* is not finished in step S22, the control returns to step S12.

The thrust cylinders 13*a* to 13*f* are driven in order to change the attitude as determined in step S22, the new movement prediction line D1 is computed on the basis of the changed attitude in steps S12 to S14, and the movement prediction line D1 is updated.

In step S15, the new target positional deviation amounts Q0*f* and Q0*r* are calculated by the position calculating component 25 on the basis of the current positional deviation amounts Q1*f* and Qir and the updated movement prediction line D1, and the display control component 26 displays the calculated target positional deviation amount Q0*f* and current positional deviation amount Q1*f* as illustrated in FIG. 7B, and the display of the front body deviation amount display component 45 is updated. The display control component 26 also updates the display of the target positional deviation amount Q0*r* and the current positional deviation amount Qir on the rear body deviation amount display component 46 as illustrated in FIG. 8B.

Consequently, the operator is able to check the approach to the target position (the tunnel excavating plan line D10 or the actual result line D20) due to the change of the attitude accompanying the driving of the thrust cylinders 13*a* to 13*f*. Moreover, when the operator cannot satisfy the positional deviation amount, the attitude change is performed in step S19 and a new movement prediction line D1 can be created.

When the controller 15 determines that the control of the thrust cylinders 13*a* to 13*f* is finished in step S22, the tunneling operation is finished in step S23.

In this way, steps S12 to S21 are repeated until the control of the thrust cylinders 13*a* to 13*f* is finished. That is, until the control of the thrust cylinders 13*a* to 13*f* is finished, the movement prediction line D1 is changed as needed, and the current positional deviation amount Q1*f* and the target positional deviation amount Q0*f* on the front body deviation amount display component 45 and the current positional deviation amount Qir and the target positional deviation amount Q0*r* on the rear body deviation amount display component 46 are also changed as needed. The operator is able to manually intervene the control in steps S19 to S21 on the basis of the displays which are changed as needed.

(Operation During Reverse Travel)

Figure 12:
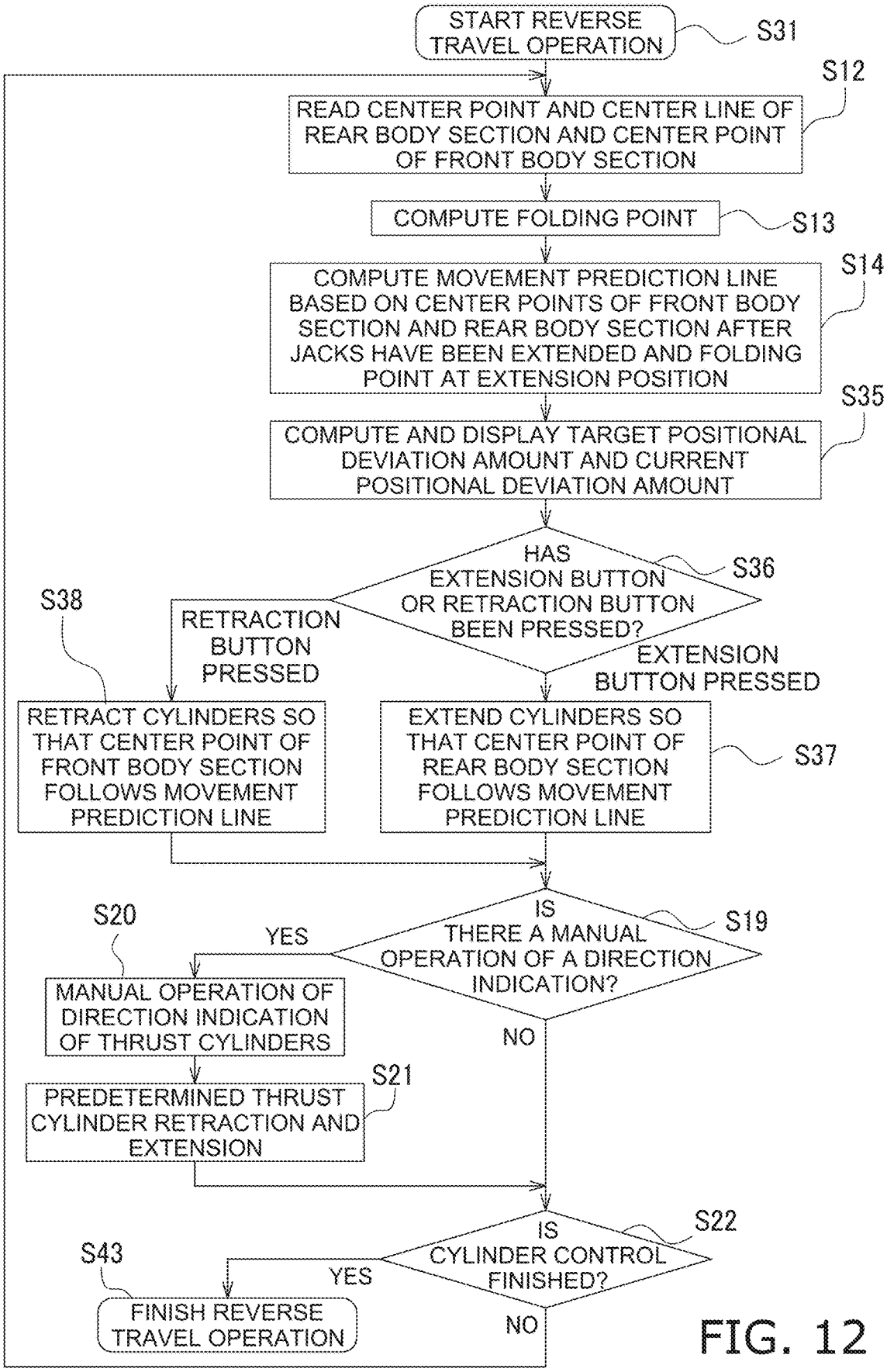
FIG. 12 is a flow chart illustrating a control operation during reverse travel of the tunnel excavation device in FIG. 1.

FIG. 12 is a flow chart illustrating a control operation of the tunnel excavation device 10 during a reverse travel operation.

The reverse travel operation is started at step S31 when the reverse travel button 42 is pressed by the operator.

The operations during reverse travel differ from steps S15 to S18 when compared to the operations during tunneling illustrated in FIG. 11. Consequently, the differences will be explained and an explanation of the other steps will be omitted.

In step S35 that replaces step S15 in FIG. 11, the operation during reverse travel includes the position calculating component 25 calculating the current positional deviation amount Q1*f* of the front body section 11 and the target positional deviation amount Q0*f* when the front body section 11 has traveled in reverse the predetermined distance M, and calculating the current positional deviation amount Qir of the rear body section 12 and the target positional deviation amount Q0*r* when the rear body section 12 has traveled in reverse the predetermined distance M. The display control component 26 then displays the current positional deviation amount Q1*f* and the target positional deviation amount Q0*f* on the front body deviation amount display component 45 as illustrated in FIG. 9A, and displays the current positional deviation amount Qir and the target positional deviation amount Q0*r* on the rear body deviation amount display component 46 as illustrated in FIG. 10A.

Next in step S36 which follows step S35, the controller 15 determines whether the extension button 44*a* has been pressed or the retraction button 44*c* has been pressed. When the retraction button 44*c* has been pressed while the grippers 11*b* of the front body section 11 protrude outward and the front body section 11 is secured to the tunnel shaft, the control advances to step S37. In step S37, the thrust cylinders 13*a* to 13*f* are extended so that the center position P1 of the rear body section 12 follows the most recent movement prediction line D1.

In step S36, when the retraction button 44*c* has been pressed while the grippers 12*a* of the rear body section 12 protrude outward and the rear body section 12 is secured to the tunnel shaft, the control advances to step S38.

In step S38, the thrust cylinders 13*a* to 13*f* are retracted so that the center position P2 of the front body section 11 follows the most recent movement prediction line D1.

When the cylinder control is finished in step S22, the reverse travel operation is finished in step S43.

When the controls of the thrust cylinders 13*a* to 13*f* in step S37 or step S38 is not finished, steps S12 to S14, step S35, and steps S19 to S21 are also repeated during the reverse travel. That is, until the control of the thrust cylinders 13*a* to 13*f* is finished, the movement prediction line D1 is changed as needed, and the target positional deviation amount Q0*f* and the current positional deviation amount Q1*f* on the front body deviation amount display component 45 and the target positional deviation amount Q0*r* and the current positional deviation amount Qir on the rear body deviation amount display component 46 are also changed as needed. The operator is able to manually intervene the control in steps S19 to S21 on the basis of the displays which are changed as needed.

A tunnel excavation device control method according to the present embodiment is a method for controlling a tunnel excavation device comprising a front body section 11 including a plurality of disk cutters 11*c* (example of cutters), a rear body section 12 disposed to the rear of the front body section 11, and a plurality of thrust cylinders 13*a* to 13*f* disposed between the front body section 11 and the rear body section 12, the method comprising step S21 (example of a first forward travel step) and step S22 (example of a second forward travel step). Step S21 involves controlling the plurality of thrust cylinders 13*a* to 13*f* so that the front body section 11 moves forward along the movement prediction line D1 set on the basis of the tunnel excavating plan line D10 (example of the first path line) while the grippers 12*a* of the rear body section 12 protrude outward and the rear body section 12 is secured to the inner wall of the tunnel. Step S22 involves controlling the plurality of thrust cylinders 13*a* to 13*f* so that the rear body section 12 moves forward along the movement prediction line D1 set on the basis of the actual result line D20 (example of the second path line) while the grippers 11*b* of the front body section 11 protrude outward and the front body section 11 is secured to the inner wall of the tunnel.

In this way, when the tunnel excavation device 10 travels forward, the rear body section 12 is made to move along the movement prediction line D1 that is set on the basis of the actual result line D20, whereby not only the front body section 11 but also the rear body section 12 is able to move along the inner wall of the tunnel even in a sharp curve.

A control method for the tunnel excavation device 10 according to the present embodiment is a method for controlling the tunnel excavation device 10 comprising a front body section 11 including a plurality of disk cutters 11*c* (example of cutters), a rear body section 12 disposed to the rear of the front body section 11, and a plurality of thrust cylinders 13*a* to 13*f* disposed between the front body section 11 and the rear body section 12, the method comprising step S41 (example of a first reverse travel step). Step S41 involves controlling the plurality of thrust cylinders 13*a* to 13*f* so that the rear body section 12 moves in reverse along the movement prediction line D1 set on the basis of the actual result line D30 (example of the third path line) while the grippers 11*b* of the front body section 11 protrude outward and the front body section 11 is secured to the inner wall of the tunnel.

In this way, when the tunnel excavation device 10 travels in reverse, the rear body section 12 is made to move along the movement prediction line D1 that is set on the basis of the actual result line D30, whereby not only the front body section 11 but also the rear body section 12 is able to move along the inner wall of the tunnel even in a sharp curve.

The control method for the tunnel excavation device 10 according to the present embodiment further comprises step S42 (example of a second reverse travel step). Step S42 involves controlling the plurality of thrust cylinders 13*a* to 13*f* so that the front body section 11 moves in reverse along the movement prediction line D1 set on the basis of the actual result line D30 (example of the third path line) while the grippers 12*a* of the rear body section 12 protrude outward and the rear body section 12 is secured to the inner wall of the tunnel.

In this way, when the tunnel excavation device 10 travels in reverse, the front body section 11 is made to move along the movement prediction line D1 that is set on the basis of the actual result line D30, whereby the rear body section 12 is also able to move along the inner wall of the tunnel even in a sharp curve.

In the control method for the tunnel excavation device 10 according to the present embodiment, the movement prediction line D1 in step S21 is set on the basis of the tunnel excavating plan line D10.

The movement prediction line D1 is set so as to follow the tunnel excavating plan line D10 whereby the front body section 11 is able to move along the tunnel excavating plan line D10.

In the control method for the tunnel excavation device 10 according to the present embodiment, the movement prediction line D1 in step S22 is set on the basis of the actual result line D20 along which the front body section 11 has moved.

Consequently, the rear body section 12 is able to move along the inner wall of the tunnel formed by the excavating by the front body section 11.

In the control method for the tunnel excavation device 10 according to the present embodiment, the movement prediction line D1 in steps S41 and S42 is set on the basis of the actual result line D30 of the tunnel excavation along which the front body section 11 or the rear body section 12 has moved.

Consequently, reverse travel along the inner wall of the tunnel formed by the forward travel is made possible.

In the control method for the tunnel excavation device 10 according to the present embodiment, the plurality of thrust cylinders 13*a* to 13*f* are controlled so that the center position P2 of the front body section 11 follows the movement prediction line D1 in step S21 (example of the first forward travel step).

Consequently, the front body section 11 is able to move forward along the movement prediction line D1.

In the control method for the tunnel excavation device 10 according to the present embodiment, the plurality of thrust cylinders 13*a* to 13*f* are controlled so that the center position P1 of the rear body section 12 follows the movement prediction line D1 in step S22 (example of the second forward travel step).

Consequently, the rear body section 12 is able to move forward along the movement prediction line D1.

In the control method for the tunnel excavation device 10 according to the present embodiment, the plurality of thrust cylinders 13*a* to 13*f* are controlled so that the center position P1 of the rear body section 12 follows the movement prediction line D1 in step S41 (example of the first reverse travel step).

Consequently, the rear body section 12 is able to move in reverse along the movement prediction line D1.

In the control method for the tunnel excavation device 10 according to the present embodiment, the plurality of thrust cylinders 13*a* to 13*f* are controlled so that the center position P2 of the front body section 11 follows the movement prediction line D1 in step S42 (example of the second reverse travel step).

Consequently, the front body section 11 is able to move in reverse along the movement prediction line D1.

In the control method for the tunnel excavation device 10 according to the present embodiment, the movement prediction line D1 is derived from the center position P2 of the front body section 11, the center position P1 of the rear body section 12, and the folding point Px that is the intersection of the center line C2 of the front body section 11 and the center line C1 of the rear body section 12.

Consequently, the movement prediction line D1 along which the front body section 11 is predicted to move or the movement prediction line D1 along which the rear body section 12 is predicted to move is calculated.

The control method for the tunnel excavation device 10 according to the present embodiment further comprises step S15 (example of a first forward travel display step). Step S15 involves displaying the target positional deviation amount Q0*f* (example of a first positional deviation amount) from a target position (example of a position) on the tunnel excavating plan line D10 (example of the first path line) at the predetermined distance M from the front body section 11.

According to this display, the operator is able to check the deviation amount between the first path line and the movement prediction line D1, is able to change the movement prediction line D1 by, for example, manually operating the thrust cylinders 13*a* to 13*f*, and is able to set the movement prediction line D1 so as to approach the first path line. As a result, the front body section can be made to travel forward along a plan line when, for example, the first path line is the plan line for the tunnel excavation.

The control method for the tunnel excavation device 10 according to the present embodiment further comprises step S15 (example of a second forward travel display step). Step S15 involves displaying the target positional deviation amount Q0*r* (example of a second positional deviation amount) from a target position (example of a position) on the actual result line D20 (example of the second path line) at the predetermined distance M from the rear body section 12.

According to this display, the operator is able to check the deviation amount between the actual result line D20 and the movement prediction line D1, is able to change the movement prediction line D1 by, for example, manually operating the thrust cylinders 13*a* to 13*f*, and is able to set the movement prediction line D1 so as to approach the actual result line D20. As a result, the rear body section 12 can be made to travel forward along the actual result line D20.

The control method for the tunnel excavation device 10 according to the present embodiment further comprises step S35 (example of a first reverse travel display step). Step S35 involves displaying the target positional deviation amount Q0*f* (example of a third positional deviation amount) from a target position (example of a position) on the actual result line D30 (example of the third path line) at the predetermined distance M from the front body section 11.

According to this display, the operator is able to check the deviation amount between the actual result line D30 and the movement prediction line D1, is able to change the movement prediction line D1 by, for example, manually operating the thrust cylinders 13*a* to 13*f*, and is able to set the movement prediction line D1 so as to approach the actual result line D30. As a result, the front body section 11 can be made to travel in reverse along the actual result line D30.

The control method for the tunnel excavation device 10 according to the present embodiment further comprises step S35 (example of a second reverse travel display step). Step S35 involves displaying the target positional deviation amount Q0*f* (example of a fourth positional deviation amount) from a target position (example of a position) on the actual result line D30 at the predetermined distance M from the rear body section 12.

According to this display, the operator is able to check the deviation amount between the actual result line D30 and the movement prediction line D1, is able to change the movement prediction line D1 by, for example, manually operating the thrust cylinders 13*a* to 13*f*, and is able to set the movement prediction line D1 so as to approach the actual result line D30. As a result, the rear body section 12 can be made to travel in reverse along the actual result line D30.

In the control method for the tunnel excavation device 10 according to the present embodiment, step S15 (example of the first forward travel display step) involves displaying the target positional deviation amount Q0*f* (example of the first positional deviation amount) as well as the current positional deviation amount Q1*f* (example of the fifth positional deviation amount) from the tunnel excavating plan line D10 (example of the first path line) at the current position of the front body section 11.

Consequently, when the tunnel excavation device 10 has traveled forward in the current attitude, the operator can easily determine whether the positional deviation amount from the tunnel excavating plan line D10 of the front body section 11 is smaller than the current state.

In the control method for the tunnel excavation device 10 according to the present embodiment, step S15 (example of the first forward travel display step) involves displaying the target positional deviation amount Q0*r* (example of the second positional deviation amount) as well as the current positional deviation amount Qir (example of the sixth positional deviation amount) from the actual result line D20 (example of the second path line) at the current position of the rear body section 12.

Consequently, when the tunnel excavation device 10 has traveled forward in the current attitude, the operator can easily determine whether the positional deviation amount from the actual result line D20 of the rear body section 12 is smaller than the current state.

In the control method for the tunnel excavation device 10 according to the present embodiment, step S35 (example of the first reverse travel display step) involves displaying the target positional deviation amount Q0*r* (example of the third positional deviation amount) as well as the current positional deviation amount Qir (example of the seventh positional deviation amount) from the actual result line D30 (example of the third path line) at the current position of the rear body section 12.

Consequently, when the tunnel excavation device 10 has traveled in reverse in the current attitude, the operator can easily determine whether the positional deviation amount from the actual result line D30 of the rear body section 12 is smaller than the current state.

In the control method for the tunnel excavation device 10 according to the present embodiment, step S35 (example of the second reverse travel display step) involves displaying the target positional deviation amount Q0*f* (example of the fourth positional deviation amount) as well as the current positional deviation amount Q1*f* (example of the eighth positional deviation amount) from the actual result line D30 (example of the third path line) at the current position of the front body section 11.

Consequently, when the tunnel excavation device 10 has traveled in reverse in the current attitude, the operator can easily determine whether the positional deviation amount from the actual result line D30 of the front body section 11 is smaller than the current state.

The tunnel excavation device 10 of the present embodiment includes the front body section 11, the rear body section 12, and the plurality of thrust cylinders 13*a* to 13*f*. The front body section 11 includes a plurality of disk cutters 11*c* (example of the cutters) and grippers 11*b* that press against an inner wall of the tunnel. The rear body section 12 includes the grippers 12*a* that press against the inner wall of the tunnel, and is disposed to the rear of the front body section 11. The plurality of thrust cylinders 13*a* to 13*f* are disposed between the front body section 11 and the rear body section 12. The controller 15 controls the plurality of thrust cylinders 13*a* to 13*f* so that the front body section 11 moves forward along the movement prediction line D1 set on the basis of the tunnel excavating plan line D10 (example of the first path line) while the grippers 12*a* of the rear body section 12 protrude outward and the rear body section 12 is secured to the inner wall of the tunnel, and controls the plurality of thrust cylinders 13*a* to 13*f* so that the rear body section 12 moves forward along the movement prediction line D1 set on the basis of the actual result line D20 (example of the second path line) while the grippers 11*b* of the front body section 11 protrude outward and the front body section 11 is secured to the inner wall of the tunnel.

In this way, when the tunnel excavation device 10 travels forward, the rear body section 12 is made to move along the movement prediction line D1 that is set on the basis of the actual result line D20, whereby not only the front body section 11 but also the rear body section 12 is able to move along the inner wall of the tunnel even in a sharp curve.

The tunnel excavation device 10 of the present embodiment includes the front body section 11, the rear body section 12, and the plurality of thrust cylinders 13*a* to 13*f*. The front body section 11 includes a plurality of disk cutters 11*c* (example of the cutters) and grippers 11*b* that press against an inner wall of the tunnel. The rear body section 12 includes the grippers 12*a* that press against the inner wall of the tunnel, and is disposed to the rear of the front body section 11. The plurality of thrust cylinders 13*a* to 13*f* are disposed between the front body section 11 and the rear body section 12. The controller 15 controls the plurality of thrust cylinders 13*a* to 13*f* so that the rear body section 12 moves in reverse along the movement prediction line D1 set on the basis of the actual result line D30 (example of a third path line) while the grippers 11*b* of the front body section 11 protrude outward and the front body section 11 is secured to the inner wall of the tunnel.

In this way, when the tunnel excavation device 10 travels in reverse, the rear body section 12 is made to move along the movement prediction line D1 that is set on the basis of the actual result line D30, whereby not only the front body section 11 but also the rear body section 12 is able to move along the inner wall of the tunnel even in a sharp curve.

In the tunnel excavation device 10 according to the present embodiment, the controller 15 controls the plurality of thrust cylinders 13*a* to 13*f* so that the front body section 11 moves in reverse along the movement prediction line D1 set on the basis of the actual result line D30 while the grippers 12*a* of the rear body section 12 protrude outward and the rear body section 12 is secured to the inner wall of the tunnel.

In this way, when the tunnel excavation device 10 travels in reverse, the front body section 11 is made to move along the movement prediction line D1 that is set on the basis of the actual result line D30, whereby the rear body section 12 is also able to move along the inner wall of the tunnel even in a sharp curve.

Although an embodiment of the present invention has been described herein, the present invention is not limited to the above embodiment and various modifications may be made within the scope of the invention.

While the current positional deviation amount Q1*f* and the target positional deviation amount Q0*f* of the front body section 11 and the current positional deviation amount Qir and the target positional deviation amount Q0*r* of the rear body section 12 are displayed on separate display components (the front body deviation amount display component 45 and the rear body deviation amount display component 46) in the above embodiment, the positional deviation amounts may be displayed on one display component.

While the current positional deviation amount Q1*f* and the target positional deviation amount Q0*f* of the front body section 11 and the current positional deviation amount Qir and the target positional deviation amount Q0*r* of the rear body section 12 are computed and displayed in one step S15 in the above embodiment, the computation and display of the current positional deviation amount Q1*f* and the target positional deviation amount Q0*f* and the computing and display of the current positional deviation amount Qir and the target positional deviation amount Q0*r* may be performed in separate steps.

An example of the tunnel excavation device 10 comprising the linking mechanism 13 including six sets of the thrust cylinders 13*a* to 13*f* in the above embodiment. However, the present invention is not limited in this way.

The number of thrust cylinders that constitute the link mechanism may be any number greater than six such as eight or ten.

While a touch panel type monitor display screen was explained as an example of the display input component 16 in the above embodiment, the present invention is not limited in this way and, for example, the operation input may be performed using a keyboard or a mouse while viewing a general PC screen and the display component and the input component may be divided.

While a secondary Bezier curve that is a parametric curve is used as the generated curve in the above embodiment, the present invention is not limited in this way.

For example, a spline curve may be used as the parametric curve.

While the first path line is described as the tunnel excavating plan line D10 and the second path line is described as the actual result line D20 as examples in the above embodiment, the present invention is not limited in this way and the first path line and the second path line may be the same and, for example, the second path line may also be the tunnel excavating plan line D10.

An example in which various operating components (the tunneling/reverse travel setting component 30, the attitude changing component 31, and the deviation amount display component 32) are disposed on the display input component 16 is described in the above embodiment. However, present invention is not limited in this way.

For example, another form may be used as the display form displayed on the monitor display screen.

While the presence of a manual operation by the operator is determined in step S19 in the above embodiment, the direction correction operation in step S20 is reflected in the extension and retraction of the thrust cylinders in step S21, and the operator checks the positional deviation amount and performs the direction correction, these operations may be performed with an automatic control. For example, the controller may automatically check the positional deviation amount and automatically issue a direction correction command for reducing the positional deviation amount.

The control method for the tunnel excavation device and the tunnel excavation device of the present invention demonstrate the effect of being able to move along a tunnel inner wall even when there is a sharp curve and therefore are industrially applicable to excavating a mine and the like.

What is claimed is:

1. A control method for a tunnel excavation device comprising a front body section including a plurality of cutters, a rear body section disposed to a rear of the front body section, and a plurality of thrust cylinders disposed between the front body section and the rear body section, the method comprising:

a first forward travel step for controlling the plurality of thrust cylinders so that the front body section moves forward along a first movement prediction line set based on a first path line while grippers of the rear body section protrude outward and the rear body section is secured to an inner wall of a tunnel, the first path line being an excavation plan line of the tunnel; and a second step for controlling the plurality of thrust cylinder so that the rear body section moves forward along a second movement prediction line set based on a second path line while grippers of the front body section protrude outward and the front body section is secured to the inner wall of the tunnel, the second path line being an actual result line of tunnel excavation on which the front body section moved.

2. The control method for the tunnel excavation device according to claim 1, wherein in the first forward travel step, the plurality of thrust cylinders are controlled so that a center position of the front body section follows the first movement prediction line.

3. The control method for the tunnel excavation device according to claim 1, wherein in the second forward travel step, the plurality of thrust cylinders are controlled so that a center position of the rear body section follows the second movement prediction line.

4. The control method for the tunnel excavation device according to claim 1, wherein the first and second movement prediction lines are derived from a center position of the front body section, a center position of the rear body section, and a bending point that is an intersection of a center line of the front body section and a center line of the rear body section.

5. The control method for the tunnel excavation device according to claim 1, further comprising a first forward travel display step for displaying a first positional deviation amount between a position on the first path line at a predetermined distance from the front body section and a position on the first movement prediction line set based on the first path line.

6. The control method for the tunnel excavation device according to claim 5, wherein the first forward travel display step includes also displaying a fifth positional deviation amount from the first path line of a current position of the front body section, together with the first positional deviation amount.

7. The control method for the tunnel excavation device according to claim 1, further comprising a second forward travel display step for displaying a second positional deviation amount between a position on the second path line at a predetermined distance from the rear body section and a position on the second movement prediction line set based on the second path line.

8. The control method for the tunnel excavation device according to claim 7, wherein the second forward travel display step includes also displaying a sixth positional deviation amount from the second path line of a current position of the rear body section, together with the second positional deviation amount.

9. A control method for a tunnel excavation device comprising a front body section including a plurality of cutters, a rear body section disposed to a rear of the front body section, and a plurality of thrust cylinders disposed between the front body section and the rear body section, the method comprising:

a first reverse travel step for controlling the plurality of thrust cylinders so that the rear body section moves in reverse along a third movement prediction line set based on a third path line while grippers of the front body section protrude outward and the front body section is secured to an inner wall of the tunnel, the third path line being an actual result line of tunnel excavation on which the front body section or the rear body section moved.

10. The control method for the tunnel excavation device according to claim 9, further comprising a second reverse travel step for controlling the plurality of thrust cylinders so that the front body section moves in reverse along the third movement prediction line set based on the third path line while grippers of the rear body section protrude outward and the rear body section is secured to the inner wall of the tunnel.

11. The control method for the tunnel excavation device according to claim 10, wherein in the second reverse travel step, the plurality of thrust cylinders are controlled so that a center position of the front body section follows the third movement prediction line.

12. The control method for the tunnel excavation device according to claim 10, further comprising a second reverse travel display step for displaying a fourth positional deviation amount between a position on the third path line at a predetermined distance from the front body section and a position on the third movement prediction line set based on the third path line.

13. The control method for the tunnel excavation device according to claim 12, wherein the second reverse travel display step includes also displaying an eighth positional deviation amount from the third path line of a current position of the front body section, together with the fourth positional deviation amount.

14. The control method for the tunnel excavation device according to claim 9, wherein in the first reverse travel step, the plurality of thrust cylinders are controlled so that a center position of the rear body section follows the third movement prediction line.

15. The control method for the tunnel excavation device according to claim 9, further comprising a first reverse travel display step for displaying a third positional deviation amount between a position on the third path line at a predetermined distance from the rear body section and a position on the third movement prediction line set based on the third path line.

16. The control method for the tunnel excavation device according to claim 15, wherein the first reverse travel display step includes also displaying a seventh positional deviation amount from the third path line of a current position of the rear body section, together with the third positional deviation amount.

17. A tunnel excavation device comprising:

a front body section including a plurality of cutters and grippers configured to press against an inner wall of a tunnel;

a rear body section including grippers configured to press against the inner wall of the tunnel, the rear body section being disposed to a rear of the front body section;

a plurality of thrust cylinders disposed between the front body section and the rear body section; and a controller configured to control the plurality of thrust cylinders so that the front body section moves forward along a first movement prediction line set based on a first path line while the grippers of the rear body section protrude outward and the rear body section is secured to the inner wall of the tunnel, the first path line being an excavation plan line of the tunnel, and control the plurality of thrust cylinder so that the rear body section moves forward along a second movement prediction line set based on a second path line while the grippers of the front body section protrude outward and the front body section is secured to the inner wall of the tunnel, the second path line being an actual result line of tunnel excavation on which the front body section moved.

18. A tunnel excavation device comprising:

a front body section including a plurality of cutters and grippers configured to press an inner wall of a tunnel;

a rear body section including grippers configured to press the inner wall of the tunnel, the rear body section being disposed to a rear of the front body section;

a plurality of thrust cylinders disposed between the front body section and the rear body section; and a controller configured to control the plurality of thrust cylinder so that the rear body section moves in reverse along a third movement prediction line set based on a third path line while the grippers of the front body section protrude outward and the front body section is secured to the inner wall of the tunnel, the third path line being an actual result line of tunnel excavation on which the front body section or the rear body section moved.

19. The tunnel excavation device according to claim 18, wherein the controller is configured to control the plurality of thrust cylinders so that the front body section moves in reverse along the third movement prediction line set based on the third path line while the grippers of the rear body section protrude outward and the rear body section is secured to the inner wall of the tunnel.

* * * * *